US012152283B2

(12) United States Patent
Schreiber et al.

(10) Patent No.: US 12,152,283 B2
(45) Date of Patent: Nov. 26, 2024

(54) DEVICE AND METHOD FOR FILLING A TAP HOLE OF AN ELECTRIC ARC FURNACE WITH REFRACTORY FILLING MATERIAL

(71) Applicant: Badische Stahl-Engineering GmbH, Kehl (DE)

(72) Inventors: Danny Schreiber, Kehl (DE); Tim Steurer, Willstätt (DE)

(73) Assignee: BADISCHE STAHL-ENGINEERING GMBH, Kehl (DE)

( * ) Notice: Subject to any disclaimer, the term of this patent is extended or adjusted under 35 U.S.C. 154(b) by 300 days.

(21) Appl. No.: 17/675,755

(22) Filed: Feb. 18, 2022

(65) Prior Publication Data

US 2023/0265534 A1 Aug. 24, 2023

(51) Int. Cl.
*C21C 5/52* (2006.01)

(52) U.S. Cl.
CPC ..... *C21C 5/52* (2013.01)

(58) Field of Classification Search
CPC . C21B 7/12; C21C 5/52; C21C 5/4653; F27B 3/085; F27D 3/1536; F27D 3/1509; F27D 25/00; F27D 3/1518
USPC ..... 266/45, 135, 271, 272, 273
See application file for complete search history.

(56) References Cited

U.S. PATENT DOCUMENTS 3,973,761 A 8/1976 Pelletier et al.
4,033,565 A * 7/1977 Ueno ..... C21B 7/12 266/273
4,247,088 A * 1/1981 Ueno ..... C21B 7/12 266/273

(Continued)

FOREIGN PATENT DOCUMENTS

AT 403774 B 5/1998
CN 1087428 A 6/1994

(Continued)

OTHER PUBLICATIONS

Ralf Schweikle, et al. "Integrated EAF safety concept of "BADISCHE-Group; SMS Siemag AG, Dusseldorf, Germany, 2017.

(Continued)

*Primary Examiner* — Jessee R Roe
*Assistant Examiner* — Michael Aboagye
(74) *Attorney, Agent, or Firm* — J-TEK LAW PLLC; Jeffrey D. Tekanic; Scott T. Wakeman

(57) ABSTRACT

A tap hole filling device for an electric arc furnace (1) includes a pivot arm (30) pivotable between a parking position and an operating position, a pivot arm actuator (40), an actuator link mechanism (50), and a refractory filling material dispenser (60) attached to an end portion (31) of the pivot arm to dispense refractory filling material (S) from a dispensing opening thereof while the pivot arm is in the operating position. The actuator link mechanism includes a connector (51) that is moveable between a connecting position, where the connector connects the pivot arm and the pivot arm actuator such that the pivot arm actuator (40) can pivot the pivot arm between the parking position and the operating position in an automatic operation mode, and a disconnected position, where the connector does not connect the pivot arm and the pivot arm actuator, to enable a manual operation mode.

21 Claims, 8 Drawing Sheets

(56) References Cited

U.S. PATENT DOCUMENTS

| | | | | |
|---|---|---|---|---|
| 4,557,468 | A * | 12/1985 | Mailliet | C21B 7/12 266/273 |
| 4,679,773 | A | 7/1987 | Wunsche | |
| 4,747,582 | A | 5/1988 | Bergstrom et al. | |
| 4,875,663 | A | 10/1989 | Forestier | |
| 5,153,894 | A | 10/1992 | Ehle et al. | |
| 6,110,415 | A | 8/2000 | Hickman et al. | |
| 6,185,242 | B1 | 2/2001 | Arthur et al. | |
| 8,700,197 | B2 | 4/2014 | Plociennik et al. | |
| 9,500,412 | B2 | 11/2016 | Monti | |
| 9,759,490 | B2 | 9/2017 | Calvi et al. | |
| 11,852,414 | B2 * | 12/2023 | Volkert | F27D 25/00 |
| 2011/0295399 | A1 | 12/2011 | Plociennik et al. | |
| 2013/0320601 | A1 | 12/2013 | Kephart et al. | |
| 2016/0153714 | A1 | 6/2016 | Dorndorf et al. | |
| 2018/0195141 | A1 | 7/2018 | Al-Harbi | |
| 2021/0048250 | A1 | 2/2021 | Celebre et al. | |
| 2021/0318069 | A1 | 10/2021 | Volkert et al. | |
| 2023/0133535 | A1 | 5/2023 | Schweikle | |

FOREIGN PATENT DOCUMENTS

| | | | | |
|---|---|---|---|---|
| CN | 2415328 | Y | 1/2001 | |
| CN | 105518401 | A | 4/2016 | |
| CN | 106498122 | A | 3/2017 | |
| CN | 108027205 | A | 5/2018 | |
| CN | 108034789 | * | 5/2018 | C21C 5/52 |
| CN | 108034789 | A | 5/2018 | |
| CN | 110923394 | A | 3/2020 | |
| DE | 8530922 | U1 | 12/1985 | |
| DE | 4034809 | A1 | 5/1992 | |
| DE | 102009051145 | A1 | 5/2010 | |
| EP | 0385434 | A2 | 9/1990 | |
| EP | 0385434 | B1 | 5/1993 | |
| EP | 2482019 | A1 | 8/2012 | |
| EP | 2482019 | B1 | 10/2014 | |
| JP | H074852 | A | 1/1995 | |
| JP | H10219329 | A | 8/1998 | |
| KR | 20130134880 | A | 12/2013 | |
| WO | 8602437 | A1 | 4/1986 | |
| WO | 2009153026 | A1 | 12/2009 | |

OTHER PUBLICATIONS

Success in Electric Steelmaking ARCCESS EAF TECHNIK, SMS Siemag AG, Dusseldorf, Germany, Mar. 2009.

Office Action from the Chinese Patent Office dispatched Apr. 7, 2022 in related Chinese application No. 202110367068.3, and machine translation thereof.

Office Action mailed Apr. 11, 2023, in related U.S. Appl. No. 17/220,574, including examined claims 1-20.

Machine Translation of Search Report from the Chinese Patent Office dated Mar. 31, 2022 in related Chinese application No. 202110367068.3.

* cited by examiner

DEVICE AND METHOD FOR FILLING A TAP HOLE OF AN ELECTRIC ARC FURNACE WITH REFRACTORY FILLING MATERIAL

TECHNICAL FIELD

The present invention relates to a device and a method for filling a tap hole of an electric arc furnace with refractory filling material.

BACKGROUND ART

Electric arc furnaces are known, for example, from EP 0 385 434 A2 (U.S. Pat. No. 5,153,894). A tap hole is designated by reference sign 21 in EP 0 385 434 A2, for example, in FIGS. 3 and 8.

Electric arc furnaces (EAF) are available in various designs in terms of the design of the tap/tapping. Tap/Tapping refers, when discussed as an action, to the process of draining or pouring liquid steel from the melting vessel during steelmaking, and refers, when discussed as a device, to the corresponding design of the metallurgical melting vessel.

EAFs can have a tap in the form of a tapping spout or in the form of a tap hole or a combination thereof such as a submerged tap hole. There are different types of EAFs with tapping holes, such as EAFs with centric bottom tapping (CBT), EAFs with offset bottom tapping (OBT), or EAFs with eccentric bottom tapping (EBT). In an EAF with OBT, the furnace bottom vessel is circular and the tap hole is offset from the center. In the case of an EAF with EBT, the furnace bottom vessel comprises a bay in which the tap hole is arranged.

The various designs differ, for example, in the way they can be operated. Depending on the design, operation with or without sump (the term "sump" means liquid molten mass remaining in the vessel after tapping) is possible. There are differences in the tilt angles required for tapping and the resulting design, differences in the cable lengths required for the power supply and therefore in the reactance, differences in the possibility of reducing the entrainment of slag, etc.

The tap hole is closed (sealed) during melting and before tapping. The tap hole is closed by a closing element like, for example, a slidable steel plate at the bottom of the furnace vessel. The closed tap hole is filled with a refractory filling material. The refractory filling material prevents a direct contact of the molten metal and the closing element, which could not withstand the high temperature of the molten metal.

Devices and methods for filling a tap hole with refractory filling material are known from e.g. US 2021/0048250 A1, US 2013/0320601 A1, JPH07-4852 A, and the paper "Integrated EAF safety concept of BADISCHE-Group" by Ralf Schweikle and Carsten Pfundstein, 2017.

US 2021/0048250 A1 discloses a device and method for filling a tap hole of an EAF with EBT with refractory filling material, wherein a sand (refractory material) dispenser is supported on a rotatable base plate which is rotated by a linear reciprocating movement of an arm of a cylinder resulting in a pivoting movement of the dispenser and wherein the dispenser has a camera to determine that sand has been filled in the tap hole.

US 2013/0320601 A1 discloses a device and method for filling a tap hole of an EAF with EBT with refractory filling material, wherein an automatic sanding hopper system and operating method is/are used to supply sand (refractory material) to a tap hole of an electric arc furnace and wherein the system has a camera to determine if the tap hole has been properly filled with sand.

JP H07-4852 A discloses a device and method for automatic filling a tap hole of an EAF with EBT with refractory filling material wherein a camera is used to determine the tap hole volume and calculate the sand volume necessary to fill the tap hole.

The paper "Integrated EAF safety concept of BADISCHE-Group" by Ralf Schweikle and Carsten Pfundstein, 2017, describes with respect to FIG. 6 thereof, a device and method for automatic filling of a tap hole of an EAF with EBT with refractory filling material. The control is integrated in the EAF control and therefore the presence of an operator in the EBT area for tap hole preparation is eliminated during normal EAF operation. The hole cycle of filling can be observed by the operator by a dedicated camera.

SUMMARY OF THE INVENTION

The present disclosure is mainly concerned with techniques for improving a device and a method for filling a tap hole of a furnace vessel of an electric arc furnace (EAF) with eccentric bottom tapping (EBT) or with offset bottom tapping (OBT) with refractory filling material, which enables an automatic filling operation in normal operation conditions and which makes it possible to switch to a manually controlled filling operation with a simple and a safe manual operation/handling in order to prevent standstill (idle) periods in case of problems with an automatic filling operation.

It is therefore one non-limiting object of the present teaching to disclose techniques for improving the switching between automatic and manually controlled filling of a tap hole of a furnace vessel of an electric arc furnace without affecting the advantages of the automatic filling operation.

In one non-limiting aspect of the present teachings, a tap hole filling device is provided for filling a tap hole of an electric arc furnace with refractory filling material, the electric arc furnace comprising a furnace vessel that includes a furnace lower vessel having an eccentric or offset bottom tap hole extending along a first longitudinal axis in a furnace vessel bay covered by a bay cover comprising an bay cover opening above the bottom tap hole and a bay cover opening lid, a furnace tilting device comprising a cradle, on which the furnace vessel is supported, configured to tilt the furnace vessel relative to a horizontal direction of a foundation that supports the electric arc furnace, a tap hole gate configured to open and close the tap hole at its bottom side, and a control system configured to control the operation of the electric arc furnace, the tap hole filling device comprising a pivot arm configured to be pivoted between a parking position and an operating position, a pivot arm actuator, an actuator link mechanism selectively connecting the pivot arm and the pivot arm actuator such that the pivot arm actuator is configured to pivot the pivot arm between the parking position and the operating position, when connected via the actuator link mechanism, and a refractory filling material dispenser having a dispensing opening at its bottom side and attached to one (first) end portion of the pivot arm and configured to dispense refractory filling material from the dispensing opening, wherein the refractory filling material dispenser is attached to the end portion of the pivot arm such that the dispensing opening is vertically above the tap hole, when the pivot arm is in the operating position such that refractory filling material dispensed from the dispensing opening is falling into the tap hole, and the actuator link mechanism comprises a connector for selectively connecting the pivot arm and the pivot arm actuator, the connector being moveable by manual or powered actuation between a connecting position, in which the connector connects the pivot arm and the pivot arm actuator such that the pivot arm actuator is configured to pivot the pivot arm between the parking position and the operating position in an automatic operation mode, and a disconnected position, in which the connector does not connect the pivot arm and the pivot arm actuator to enable a manual operation mode.

With such a device and an electric arc furnace that includes such a device, it becomes possible to easily and effectively switch to a manually controlled filling operation with a simple and a safe manual operation/handling in order to prevent standstill periods in case of problems with an automatic filling operation.

The device preferably comprises a pivot mechanism comprising a pivot console configured to be connected to the electric arc furnace and a pivot carrier having a first end and a second end and connected to the pivot console with a device center axis located between the first end and the second end of the pivot carrier, wherein the pivot arm is pivotably connected at its other (second) end portion to the pivot carrier to pivot around a first pivot axis, which is parallel to the device center axis and located at the first end of the pivot carrier, wherein the pivot carrier comprises a support at its second end to which the pivot arm actuator is attached, and wherein the actuator link mechanism is attached to the other (second) end portion of the pivot arm such the pivot arm actuator can selectively connected with and disconnected from the pivot arm by moving the connector between the connecting position and the disconnected position.

The device preferably comprises the actuator link mechanism with a bolt as the connector and flanges with openings configured to receive the bolt, and the pivot arm actuator comprises a flange with an opening configured to receive the bolt such that, when the bolt is received by the flanges of the actuator link mechanism and of the pivot arm actuator, the pivot arm and the pivot arm actuator are connected.

With such devices and an electric arc furnace that includes such devices, switching to a manually controlled filling operation is made even simpler and safer.

In one non-limiting aspect of the present teachings, an electric arc furnace comprises a furnace vessel that includes a furnace lower vessel having an eccentric or offset bottom tap hole extending along a first longitudinal axis in a furnace vessel bay, a bay cover covering the furnace vessel bay and comprising a bay cover opening above the bottom tap hole and a bay cover opening lid for opening and closing the bay cover opening, a tap hole gate configured to open and close the tap hole at its bottom side, a control system configured to control the operation of the electric arc furnace, and a tap hole filling device according to the above teachings, wherein the tap hole filling device is connected to the electric arc furnace in (at) a position offset from the bay cover opening and the bay cover opening lid, wherein the bay cover opening lid is configured to be opened and closed under the control of the control system, and wherein the tap hole filling device is connected to and controlled by the control system to pivot the pivot arm between the parking position and the operating position in an automatic operation mode and to lock the pivot arm actuator to keep the pivot arm in the parking position in a manual operation mode.

This design further enables a method for filling a tap hole of such an electric arc furnace with refractory filling material, comprising:

a) operating the tap hole filling device in an automatic mode under control of the control system with the connector of the actuator link mechanism in the connecting position, b) stopping the operation of the tap hole filling device in the automatic mode, if a problem of moving the pivot arm is detected (in response to detection of movement of the pivot arm), and setting the control to a manual mode including interrupting a supply of power to the pivot arm actuator, c) moving the connector by manual or powered actuation from the connecting position, in (at) which (where) the connector connects the pivot arm and the pivot arm actuator such that the pivot arm actuator is configured to pivot the pivot arm between the parking position and the operating position, to the disconnected position, in (at) which (where) the connector does not connect the pivot arm and the pivot arm actuator, d) positioning the refractory filling material dispenser attached to the end portion of the pivot arm such that the dispensing opening is vertically above the tap hole, e) dispensing refractory filling material from the dispensing opening into the tap hole to fill the same, and f) moving the refractory filling material dispenser with the pivot arm to the parking position.

Further objects, features, advantages and functionalities (utilities) will become apparent to a person of ordinary skill in the art upon reading the following description of the embodiments and appended claims with reference to the figures.

BRIEF DESCRIPTION OF THE DRAWINGS

FIGS. 6A-6C show the first embodiment of the device for filling a tap hole of an electric arc furnace with refractory filling material in a parking position, wherein FIG. 6A shows a top view thereof, FIG. 6B shows a rear view thereof, and FIG. 6C shows a left side view thereof.

FIGS. 7A-7D show the first embodiment of the device for filling a tap hole of an electric arc furnace with refractory filling material in an operating position, wherein FIG. 7A shows a top view thereof, FIG. 7B shows a rear view thereof, FIG. 7C shows a left side view thereof, and FIG. 7D shows a left side view thereof wherein a flow deflector/adjuster is a non-deflecting state, different from FIGS. 7A to 7C.

DETAILED DESCRIPTION OF THE EMBODIMENTS OF THE INVENTION

Figure 1:
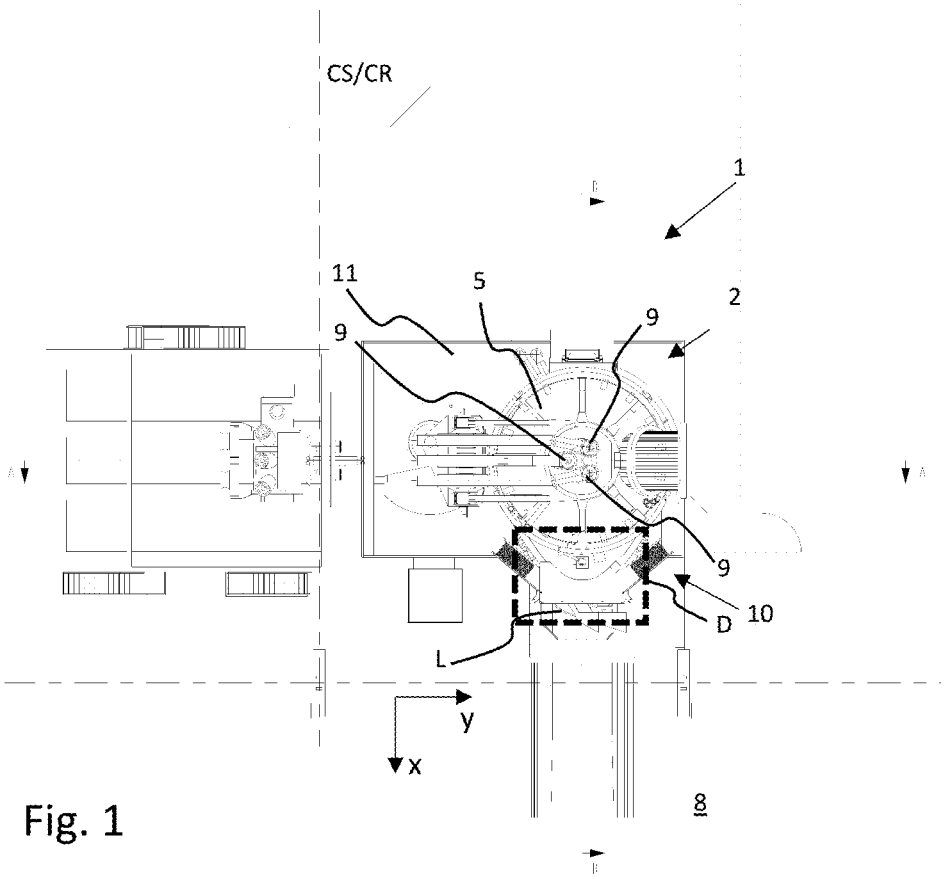
FIG. 1 shows a top view of a usual design of an electric arc furnace with EBT.
Figure 2:
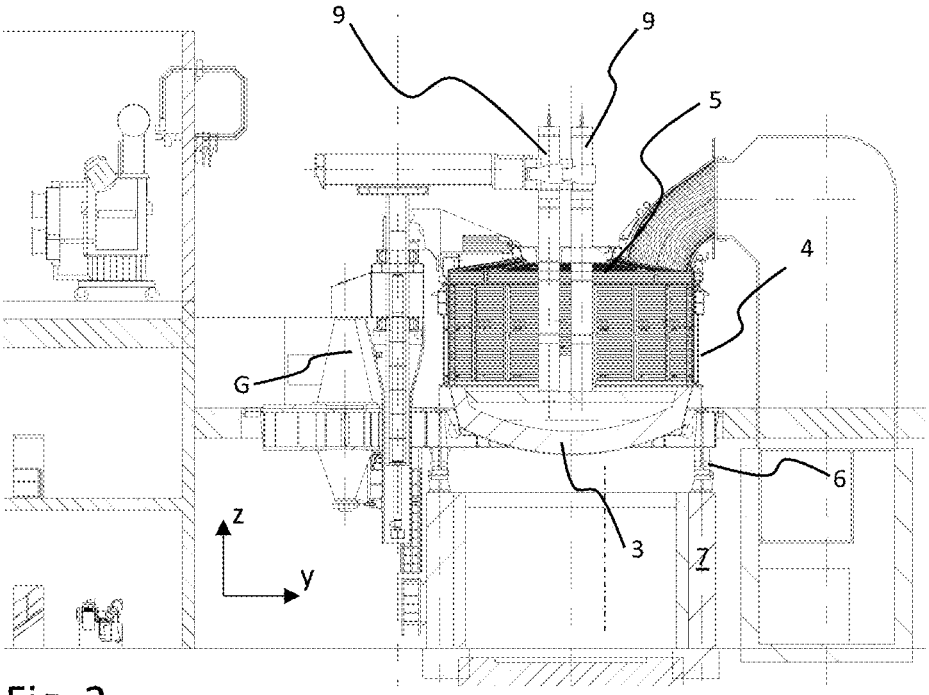
FIG. 2 shows a cross-sectional view of the electric arc furnace of FIG. 1 along line (cross-section) A-A shown in FIG. 1.
Figure 3:
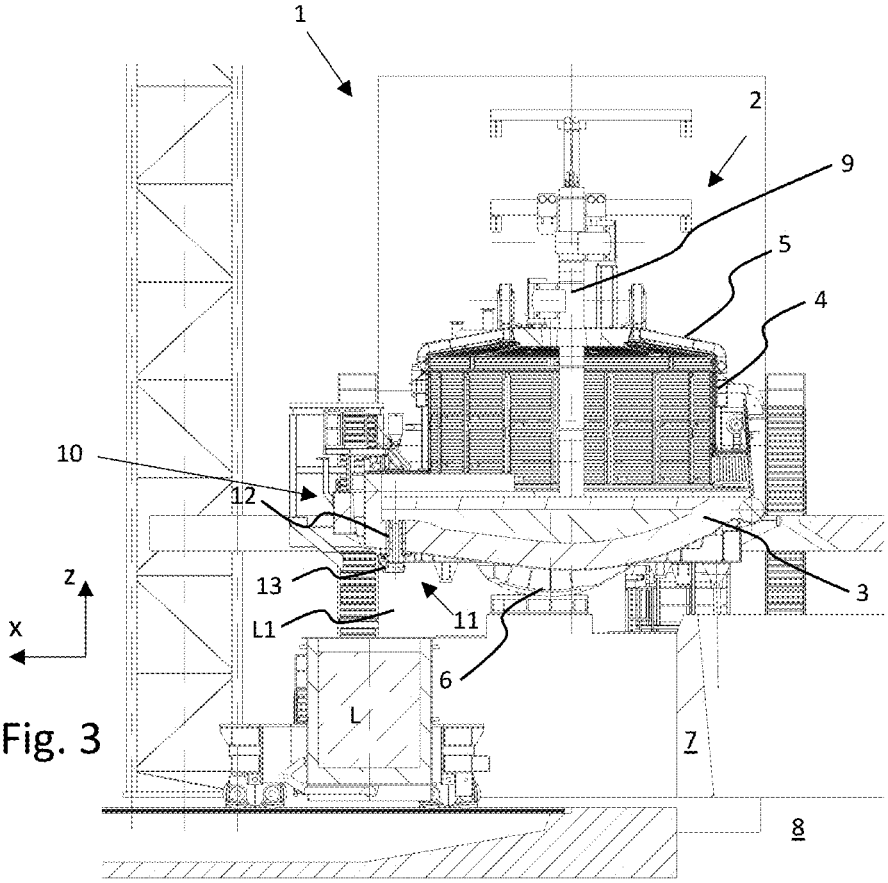
FIG. 3 shows a cross-sectional view of the electric arc furnace of FIG. 1 along line (cross-section) B-B shown in FIG. 1.
Figure 4:
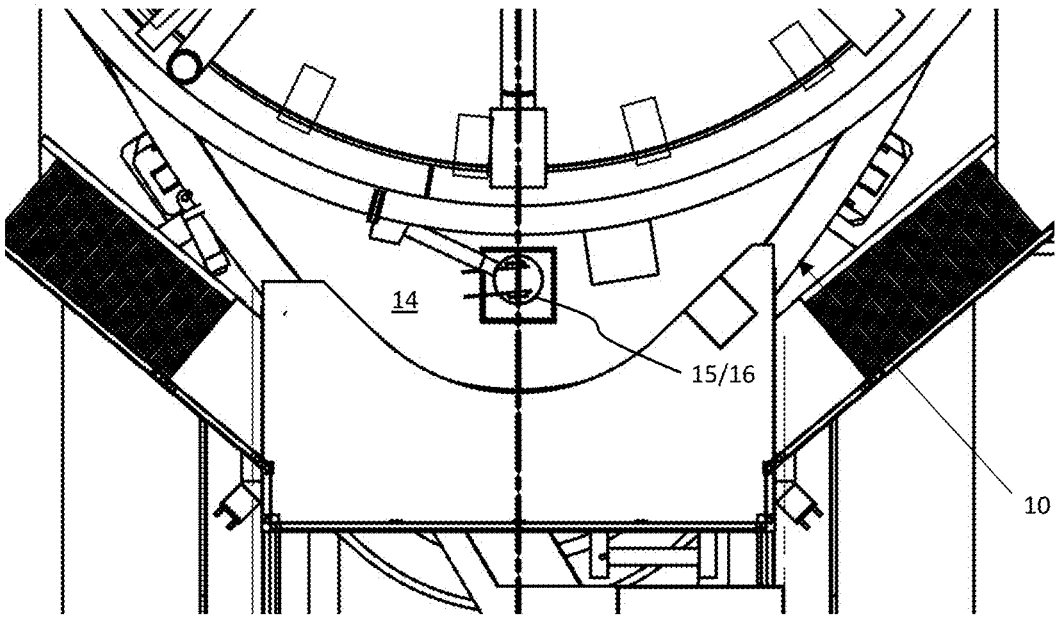
FIG. 4 shows a top view of region D in FIG. 1.

FIG. 1 shows a top view of an electric arc furnace with EBT suitable for use with the device and method of the present teachings; FIG. 2 shows a cross-sectional view of the electric arc furnace along line (cross-section) A-A shown of FIG. 1; FIG. 3 shows a cross-sectional view of the electric arc furnace of FIG. 1 along line (cross-section) B-B shown of FIG. 1; and FIG. 4 shows a top view of region D in FIG. 1.

The electric arc furnace (EAF) 1 in FIGS. 1 to 4 is not equipped with a tap hole filling device 20 according to the present teachings. Rather, the electric arc furnace 1 in FIGS. 1 to 4 is a typical EAF that could be equipped with a tap hole filling device 20 according to the present teachings as explained further below.

The EAF 1 comprises an eccentric bottom tapping (EBT) 11 as shown on the left side in FIG. 3. The EAF 1 comprises a furnace vessel 2 having a furnace lower vessel 3, a furnace upper vessel 4 and a furnace lid 5. The furnace vessel 2 is tiltably mounted on a foundation 7 via a furnace tilting device having a furnace cradle 6 and a hydraulic cylinder that is not shown. The foundation 7 is located on a floor 8, which is also referred to as the mainland (ground). The EAF 1 comprises an eccentric bottom tapping (EBT) 11 as shown on the left side in FIG. 3.

FIGS. 1, 2, 3, 4 show a coordinate system x-y-z. The direction x points in the horizontal direction from the rear to the front of the EAF, the direction y points (from left to right in FIG. 1) in the horizontal direction perpendicular to the direction x, and the direction z points in the vertical direction (from the bottom to the top in FIGS. 2, 3 and away from the paper plane in FIG. 1) perpendicular to the directions x, y and to an upper surface of the ground (floor 8, mainland). The furnace vessel 2 is shown in FIGS. 1, 2, 3, 4 in an untilted (horizontal) position. The EAF 1 can be tilted and, as used in the present description and claims, the term "tilted-forward" means that the front side with the EBT 11 (shown on the left side in FIG. 3) is lowered with respect to the untilted (horizontal) position while the back side (shown on the right side in FIG. 3) is lifted with respect to the untilted (horizontal) position, and the term "tilted-back" means that the front side with the EBT 11 (shown on the left side in FIG. 3) is lifted with respect to the untilted (horizontal) position while the back side (shown on the right side in FIG. 3) is lowered with respect to the untilted (horizontal) position.

The EAF shown is an EAF operated with alternating current and comprises three electrodes 9 (only one shown) of an electrode assembly. The electrodes 9 project through the furnace lid 5 into the furnace vessel 2 during operation and are used to generate heat energy to melt solid steel disposed in the furnace vessel 2. An EAF suitable for use with the device and method of the present teachings could also be an EAF operated with direct current (one electrode).

In such an EAF with EBT, the furnace lower vessel 3 comprises a bay 10. Such a bay 10 is a part of the furnace lower vessel 3 and projects forward in the x-direction beyond the circumference of the furnace upper vessel 4. The eccentric bottom tapping (EBT) 11 is arranged in the bay 10. The furnace lower vessel 3 comprises an outer shell made of steel lined with refractory material (lining). The EBT 11 comprises a tap hole 12 which extends linearly along a (first) longitudinal axis L1 (of the tap hole 12) through the furnace lower vessel 3, i.e., through the outer shell and the lining. The tap hole 12 is closed (sealed) during melting and before tapping by a tap hole gate 13 configured to open and close the tap hole such as a slide (not shown) at the bottom of the furnace lower vessel 3 and the closed tap hole 12 is filled with a refractory filling material before a melting process is started. The furnace vessel bay 10 is covered by a bay cover 14 comprising a bay cover opening 15 above the bottom tap hole 12 and a bay cover opening lid 16 (see FIG. 4).

The EAF 1 comprises a control system CS configured to control the operation of the electric arc furnace such as for example opening and closing of the lid, power supply of the electrodes, the tilting of the furnace vessel, opening and closing of the tap hole gate, and so on. The control system CS is, for example, housed in a control room CR (shown in FIG. 1).

The tap hole 12 has a predetermined initial inner diameter, e.g., 140 mm or 180 mm, which is constant along the longitudinal axis L1, at the beginning of a furnace cycle, i.e., the period of usability of a lining before it has to be renewed (replaced or cleaned, as will be described below). The diameter and shape of the inner periphery of the tap hole 12 change during the use of the EAF due to the highly abrasive action of the liquid steel and, if applicable, the slag, to become more like a funnel shape (instead of the original circular cylindrical shape of the inner periphery of the refractory lining) and the inner diameter of the tap hole 12 becomes larger. Therefore, the refractory lining of the tap hole 12 usually needs to be replaced more frequently than the rest of the refractory lining of the furnace 1. This is usually done by replacing the so-called tapping block, i.e., the part of the refractory lining forming the tap hole 12. Another effect of the change of the diameter and shape of the inner periphery of the tap hole 12 change during the use of the EAF is the change of the volume of the tap hole 12 and thus of the volume of the refractory filling material required to fill the tap hole.

The furnace vessel is tilted forward into a tilted-forward position during a tapping process in order to pour out the molten mass through the tap hole 12 after a melting process. The molten mass is poured into a ladle L (shown in FIGS. 1 and 3) positioned below the tap hole 12. The ladle L is carried by a carriage. The ladle L containing the molten mass is transported on rails to the next process after the tapping is finalized. Depending on the design of the EAF 1, the maximum inclination angle of the tilted-forward position may up to 18°.

After tapping, i.e. after pouring the molten steel through the tap hole, which is done by gradually tilting the furnace vessel forward, the furnace vessel is usually tilted back to an oppositely tilted position (a tilted-back position) as quickly as possible at the end of a tapping process in order to prevent, as much as possible, slag from being dragged with the molten mass during tapping. Such a tilted-back position usually has an inclination angle in a range from 5° to 10° but could also be up to 18°. In the EAF 1 of FIGS. 1 to 4 as in most EAF designs with EBT, if it is operated with "sump", a tilted-back position is required to avoid that molten mass of the sump reaches the tap hole 12 after tapping is finalized.

Thereafter the tap hole is cleaned. This cleaning is required because the tap hole is filled with the refractory filling material (sand) before the next melting process. For this purpose, it must be cleaned, e.g., to remove adhering steel or slag residues or the like. There are different techniques and devices in the prior art for this cleaning. In the preferred embodiment, the EAF 1 comprises a tap hole maintenance device as described in US 2021/318069 A1 for this purpose. The teachings of US 2021/318069 A1 are incorporated herein by reference in their entirety, and in particular with regard to the tap hole maintenance device described in paragraphs [0035]-[0064] and shown in FIGS. 1, 2 and 7 thereof.

As was described above, the tap hole 12 is closed (sealed) during melting and before tapping. The tap hole is closed by a tap hole gate configured to open and close the bottom of the tap hole, such as, for example, a slidable steel plate at the bottom of the furnace vessel. The closed tap hole is filled with a refractory filling material. The refractory filling material prevents a direct contact of the molten metal and the closing element of the tap hole gate which could not withstand the high temperature of the molten metal.

After tapping the molten metal and filling the tap hole with refractory filling material, the EAF 1 is again charged with material to be molten (such as scrap metal); the newly charged material is then molten and then tapped. The time period from one tapping to the next consecutive tapping is called "tap-to-tap-time" and is a measure for the productivity of the EAF. Any additional time needed after tapping and before charging the EAF with the next material to be molten increases the tap-to-tap-time and decreases the productivity of the EAF. The cleaning of the tap hole after tapping and the filling of the tap hole with refractory material need to be inevitably done after tapping and before charging the EAF with the next material. Therefore, it is critical to avoid additional time needed for filling the tap hole, especially if problems with an automatic filling occur.

For this purpose, a tap hole filling device for filling the tap hole with refractory filling material is provided, and the design, arrangement and method of operation of the tap hole filling device are described below. In all figures, the same reference signs are used for the same or corresponding features, except where specifically described otherwise, and the description thereof is not repeated.

A first embodiment of a device for filling a tap hole of an electric arc furnace with refractory filling material according to the present teachings is shown in and explained with respect to FIGS. 5 to 12 and an EAF 1 as shown in FIGS. 1 to 4.

Figure 5:
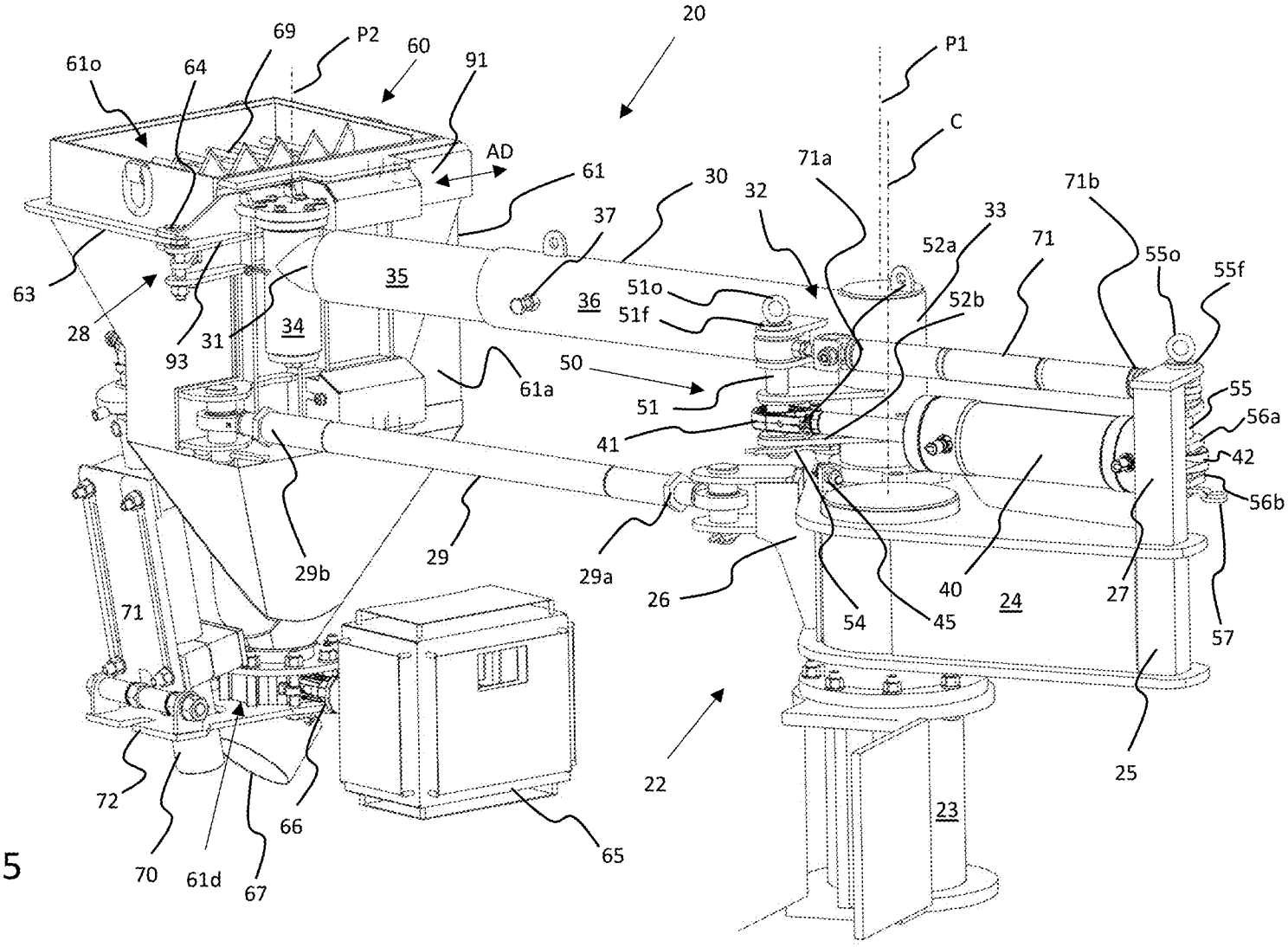
FIG. 5 shows a perspective oblique front view of a first embodiment of a device for filling a tap hole of an electric arc furnace with refractory filling material according to the present teachings.
Figure 6B:
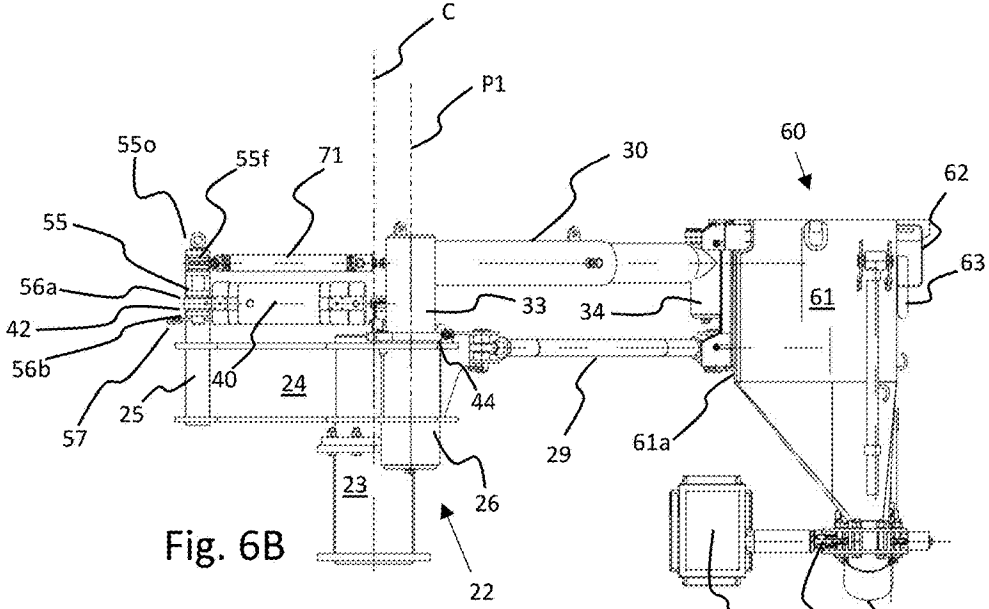
Figure 6A:
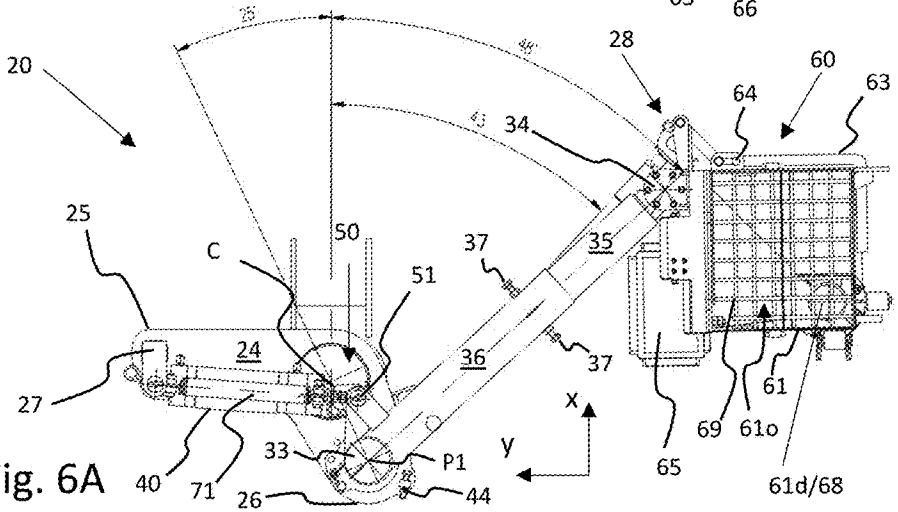
Figure 6C:
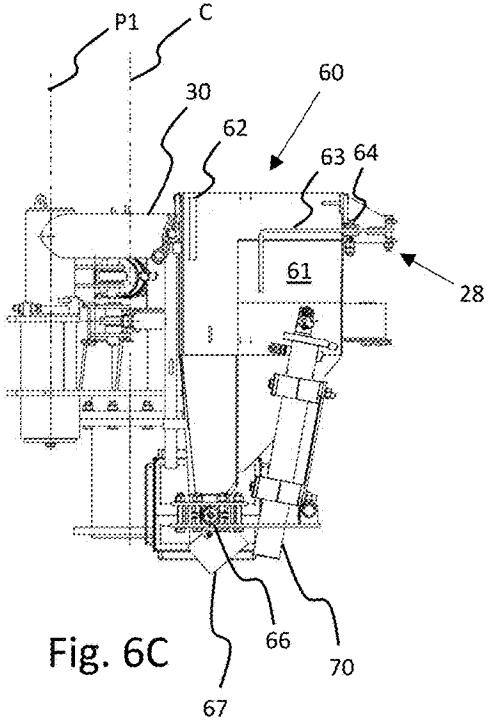
Figure 7B:
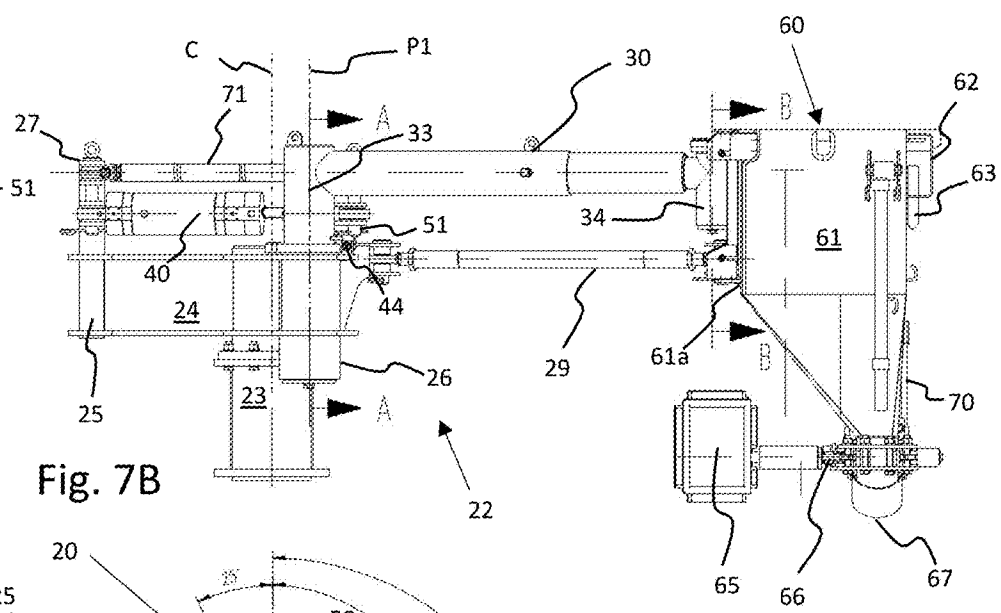
Figure 7A:
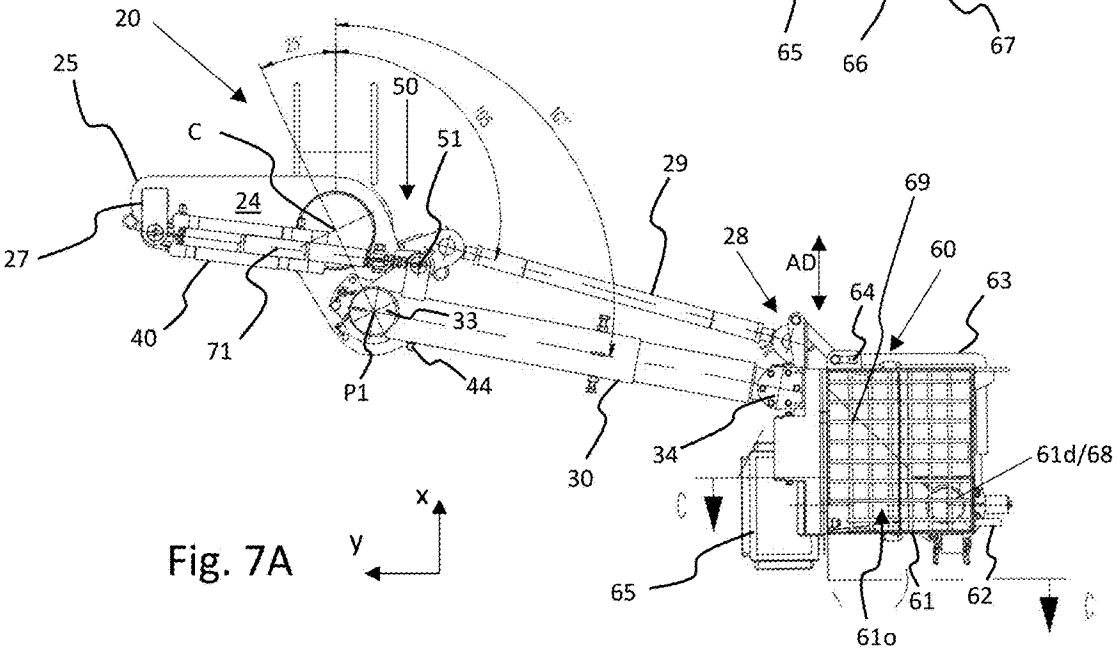
Figure 7C:
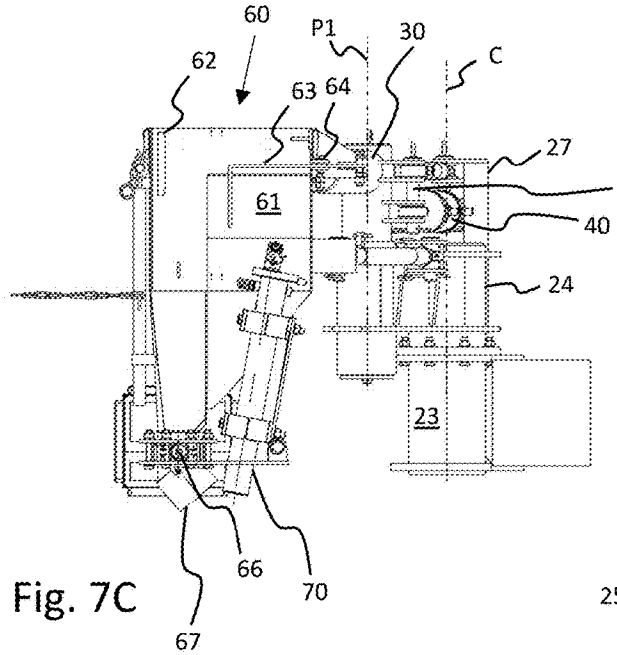

The tap hole filling device 20 for filling a tap hole 12 of an electric arc furnace 1 with refractory filling material S shown in FIG. 5 comprises a pivot arm 30 configured to be pivoted between a parking position shown in FIGS. 6A-6C and an operating position shown in FIGS. 7A-7D under the action of a pivot arm actuator 40 which is an actuator cylinder such as preferably a water-cooled hydraulic cylinder 40 in the first embodiment or a pneumatic cylinder or an electric actuator or the like. The pivot arm 30 has the shape of a longitudinally extending bar/beam with two ends, namely, one first end 31, at which a refractory filling material dispenser 60 is attached, and another (opposite) second end 32 (FIGS. 5 to 7D).

The tap hole filling device 20 comprises a pivot mechanism 22 comprising a pivot console 23 configured to be connected to the electric arc furnace 1 as described further below and a pivot carrier 24. The pivot carrier 24 has, in a top view as shown in FIGS. 6, 7, a longitudinal shape with a bend between its two ends (i.e. a first end 25 and a second end 26), and it is fixedly connected to the pivot console 23 with a device center axis C located in the bend area between the first end 25 and the second end 26 of the pivot carrier 24. The pivot arm 30 is pivotably connected at its second end portion 32 via a first pivot bearing 33 to the pivot carrier 24 to pivot around a first pivot axis P1 (of the first pivot bearing 33), which is parallel to the device center axis C and is located at the first end 25 of the pivot carrier 24. The pivot carrier 24 carries a fixed support 27 on its upper side at its second end 26.

An actuator link mechanism 50 is attached to the second end portion 32 of the pivot arm 30. The actuator link mechanism 50 comprises a connector 51 for selectively connecting the pivot arm 30 and the pivot arm actuator 40. In the first embodiment, the actuator link mechanism 50 comprises a bolt 51 as the connector and flanges 52*a*, 52*b* with openings configured to receive the bolt 51. The flanges 52*a*, 52*b* are fixedly connected, e.g., welded, to the second end portion 32 of the pivot arm 30 at a position at (on) the lateral side of the pivot arm 30 which is closer to the first end 31 of the pivot arm 30 than the first pivot axis P1.

The centers of the openings of the flanges 52*a*, 52*b* lie on a common axis which is parallel to the device center axis C and the first pivot axis P1. The pivot arm actuator comprises a flange 41 with an opening configured to receive the bolt 51 at its one end (the end of the cylinder arm) such that, when the bolt 51 is received by the flanges 52*a*, 52*b*, 41 of the actuator link mechanism 50 and of the pivot arm actuator 40, the pivot arm 30 and the pivot arm actuator 40 are connected as shown in FIGS. 5 to 7.

The bolt 51 comprises a flange 51*f* having a larger diameter than the openings of the flanges 52*a*, 52*b*, 41 at its one (upper) end and an upright ring 510 on top of the flange 51*f*. The bolt 51 comprises a groove at its other (lower) end. The groove is provided for cooperation with a spring cotter 54 to secure the bolt 51 against unintended removal.

Due to this design, the bolt 51 representing the connector is moveable by manual actuation (after removing the spring cotter) between a connecting position, in which the bolt is inserted through the openings of the flanges 52*a*, 52*b*, 41 and thus connects the pivot arm 30 and the pivot arm actuator 40, and a disconnected position, in which the bolt is pulled out of the openings of the flanges 52*a*, 52*b*, 41 and thus does not connect the pivot arm and the pivot arm actuator 40. The manual actuation can be implemented by pulling with a hook inserted through the ring 510 or by using the lever inserted between the top flange 53*a* of the actuator link mechanism 50 and the flange 51*f* of the bolt 51 or the like. It is also possible to use a powered actuation by providing a tool powered under control of the control system CS such as a hook engaging with the ring 510 for pulling the bolt 51 upwards or pushing it downwards for actuation between the connecting position and the disconnected position. However, due to the location of the tap hole filling device 20 in the vicinity of the tap hole, the manual option is preferred to reduce to possibility of tap-to-tap-time losses due to system failures in the very hostile environment.

The fixed support 27 on the upper side of the second end 26 of the pivot carrier 24 comprises a bolt 55 as a connector and flanges 56*a*, 56*b* with openings configured to receive the bolt 55. The flanges 56*a*, 56*b* are fixedly connected, e.g., welded, to the fixed support 27. The pivot arm actuator 40 comprises a flange 42 with an opening configured to receive the bolt 55 at its other end (the end of the cylinder housing)

such that, when the bolt 55 is received by the flanges 56*a*, 56*b*, 42 of the support 27 and of the pivot arm actuator 40, the support 27 and the pivot arm actuator 40 are connected as shown in FIGS. 5 to 7D.

The bolt 55 comprises a flange 55*f* having a larger diameter than the openings of the flanges 56*a*, 56*b*, 42 at its one (upper) end and an upright ring 55*o* on top of the flange 55*f*. The bolt 55 comprises a groove at its other (lower) end. The groove is provided for cooperation with a spring cotter 57 to secure the bolt 55 against unintended removal.

The pivot arm actuator 40, which is connected with the pivot arm 30 via the actuator link mechanism 50 having the connector (bolt) 51 and with the support 27 via the bolt 55 as a counter support, can pivot the pivot arm 30 around the first pivot axis P1 by changing its length between the actuator link mechanism 50 and the support 27, in other words by pushing the cylinder arm out of the cylinder or pulling the cylinder arm into the cylinder.

Accordingly, with the pivot arm actuator 40 connected with the pivot arm 30 by the connector 51 in the connected position, the pivot arm 30 can be moved/pivoted between the parking position shown in FIGS. 6A-6C and the operating position shown in FIGS 7A-7D. This movement of the pivot arm 30 with the dispenser 60 between the parking position shown and the operating position effected by the operation of the pivot arm actuator 40 is performed in an automatic mode under control by the control system CS.

If the connector 51 is in the disconnected position, the automatic mode under control by the control system CS is made impossible and a manual mode of moving the pivot arm 30 with the dispenser 60 between the parking position and the operating position is enabled, which will be described further below.

The arrangement enabling the pivoting of the pivot arm 30 with the shape of a longitudinally extending bar/beam having the first end 31, at which the refractory filling material dispenser 60 is attached, and the other (opposite) second end 32 which is connected to the actuator link mechanism 40 (and via the first pivot bearing to the pivot carrier 24), around the first pivot axis P1 was described above.

The refractory filling material dispenser 60 attached at the first end 31 of the pivot arm 30 comprises hopper 61 having a shape tapering towards its lower (bottom) end (in the z-direction, which is also the longitudinal direction of the hopper 61 that extends in parallel with the first pivot axis P1) with a discharge opening 61*d* at its lower end and with an (upper) opening 61*o* for charging refractory material into the hopper 61 as shown in FIGS. 5 to 7D and 10A. The interior volume of the hopper 61 is adapted to the volume of the tap hole 12 to be filled. In a usual EAF 1 having a usual tap hole 12 of the type described above, the volume is designed for 100 kg to 120 kg of refractory filling material (sand) S.

The (upper) opening 610 of the hopper 61 is used for charging refractory filling material into the hopper 61. A mesh 69 with spikes is provided in the upper opening to prevent debris or other foreign material from falling into the hopper 61. In normal operation, a refractory material supply system (not shown) will charge the appropriate mass/volume of refractory filling material (sand) S into the hopper. At the beginning of a furnace cycle, the appropriate mass/volume will be less than at a later point in a furnace cycle due to the change of shape of the tap hole 12. These masses/volumes are determined/stored in the control system CS. If there are problems with the refractory material supply system, the charging of refractory filling material into the hopper 61 can be effected manually by an operator through the upper opening 61*o*.

The discharge (dispensing) opening 61*d* at the lower (bottom) end of the hopper 61 is used for discharging the refractory filling material charged into the hopper 61. The discharge opening 61*d* can be opened and closed by a valve 68, which is implemented as a flange flap 68 in the first embodiment. The valve/flange flap 68 is actuated to be opened and closed by an actuator 65, which is implemented as a pneumatic actuator 65 in the first embodiment. The pneumatic actuator 65 is housed in a protective housing supported at the dispenser 61 due to the hostile environment and actuates valve/flange flap 68 via a shaft 66 connected between the pneumatic actuator 65 and the valve/flange flap 68. When the valve/flange flap 68 is open, the refractory filling material (sand) S in the hopper 61 flows in the vertical direction out of the hopper 61 through the discharge opening 61*d* under gravitational force until the valve/flange flap 68 is either closed or the hopper 61 is empty. A flow deflector/adjuster 67 for deflecting the flow of refractory filling material (sand) S out of the discharge opening 61*d* is optionally provided below the discharge opening 61*d*. The flow deflector/adjuster 67 is implemented (designed) as a circular cylinder which is open at both longitudinal ends. In normal operation, the flow of refractory filling material (sand) S out of the discharge opening 61*d* is not deflected and the flow deflector/adjuster 67 is set in a non-deflecting state shown in FIG. 7D. If the flow deflector/adjuster 67 is implemented as the above-mentioned circular cylinder, the longitudinal axis of the circular cylinder is set to coincide with the center of the (circular) discharge opening 61*d*. In order to deflect the flow of refractory filling material (sand) S out of the discharge opening 61*d*, the flow deflector/adjuster 67 is set in a deflecting state shown in FIGS. 7A to 7C and FIGS. 6A to 6C. That is, the longitudinal axis of the circular cylinder is set to be inclined relative to the vertical direction (z-direction) with the center of the (circular) discharge opening 61*d*. As a result, the flow of refractory filling material (sand) S out of the discharge opening 61*d* will at least impact on the circular cylinder wall such that it is deflected essentially in the direction of inclination of the circular cylinder axis.

Figure 10A:
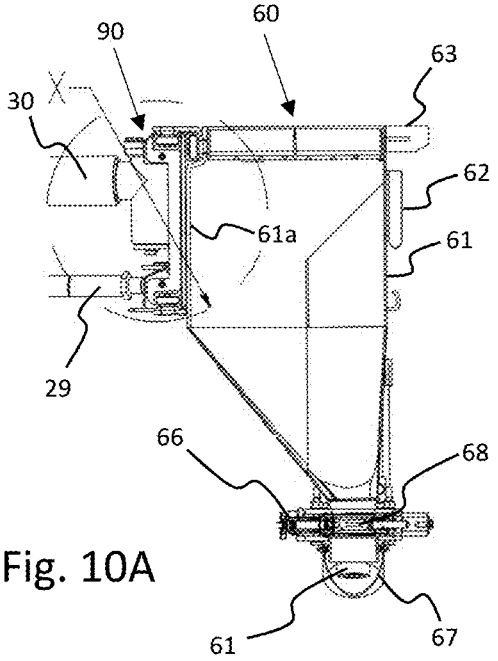
FIG. 10A shows a partly cut away rear view of the first embodiment of the device for filling a tap hole of an electric arc furnace with refractory filling material of FIGS. 5 to 7 along line C-C shown in FIG. 7A.

In the first embodiment, the hopper 61 has a shape with an essentially rectangular cross section perpendicular to the vertical direction from the top to the bottom (z-direction). In the upper part (half) of the hopper 61, the cross-section perpendicular to the vertical direction is essentially square. At one lateral side 61*a* of the four square sides of the upper part (half) of the hopper 61, the pivot arm 30 is connected via a second pivot bearing 34 as described further below. Following the upper part, the cross sectional shape of the hopper 61 is gradually reduced resulting in a tapering (tapered) shape of the hopper 61 tapering towards its lower (bottom) end on three sides of the rectangular cross-section as shown in FIGS. 5 and 10A (in the z-direction) with the discharge opening 61*d* at the lower end. The side of the rectangular cross-section not inclined is the side opposite to the lateral side 61*a* of the hopper, to which the pivot arm 30 is connected via the second pivot bearing 34. The second pivot bearing 34 has a second pivot axis P2 which is parallel to the first pivot axis P1.

The cross-sectional shape of the hopper 61 is not necessarily rectangular but could be circular or oval or polygonal or combinations thereof. However, it is preferred to have at least one flat side, to which the pivot arm 30 is connected. The reason is the option to provide a slide adjustment for the hopper position described further below, which is easier to implement with such a flat side.

As shown in FIG. 5, a camera 70 is attached to one side of the lower part of the hopper 61 adjusted for imaging the area into which the refractory filling material (sand) S is falling out of the discharge opening 61*d* under gravitational force. The camera 70 is shielded by heat protection plates 71, 72 against heat radiation and debris.

Figure 10B:
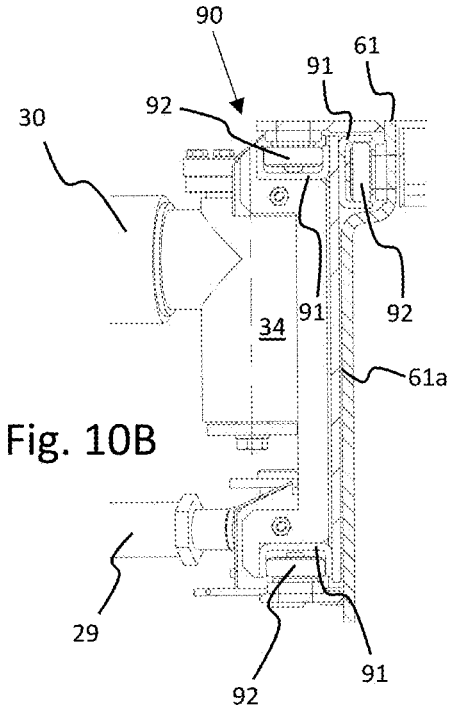
FIG. 10B shows an enlarged view of the region encircled by line X in FIG. 10A.

At the lateral side 61*a* of the upper part of the hopper 61, to which to which the pivot arm 30 is connected, a linear dispenser slide 90, for shifting the dispenser 60 in a shift direction AD perpendicular to the first pivot axis P1, is attached. As shown in FIGS. 10A and 10B, the linear dispenser slide 90 comprises rollers 92 that can roll in slide rails 91 to enable a sliding movement in the direction AD shown in FIGS. 5 and 7A. The sliding movement is generated by a linear movement of a bar 93 in the direction AD. The movement range in the direction AD is preferably 100 mm. The bar 93 is connected to a toggle joint 28 which is connected to a toggle lever 63. The toggle joint 28 comprises a removable securing bolt 64 which, when present, locks the toggle joint 28, and which when removed, releases the movement of the toggle joint 28. When the movement of the toggle joint 28 is released, the toggle joint transfers (converts) a movement of the toggle lever 63 into a linear movement of the bar 93 in the direction AD, thus allowing to adjust the position of the dispenser and as a consequence of the discharge opening 61*d* in the shift/slide direction AD.

This design enables, by simple removal of one element, namely the securing bolt 64, a manual adjustment of the hopper position, if there are problems in the automatic operation mode, and thus reduces the possibility of tap-to-tap-time losses due to system failures in the very hostile environment.

The tap hole filling device 20 further comprises a steering rod 29 having an adjustable length between its ends 29*a*, 29*b*; one of the ends 29*a* is connected to the pivot carrier 24 and the other end 29*b* is connected to the dispenser 60 as shown for example in FIG. 5. The connection between the one end 29*a* and the pivot carrier 24 is implemented as a bolt-flange connection with one first connection bolt 29*c* and with two flanges welded to the pivot carrier 24 having openings adapted to receive the bolt 29*c* and with one flange having an having an opening adapted to receive the bolt 29*c* at the one end 29*a* of the steering rod 29. The connection between the other end 29*b* and the dispenser 60 is implemented as a corresponding bolt-flange connection with one second connection bolt 29*d* and with two flanges welded to the dispenser 60 (at the hopper 61) having openings adapted to receive the bolt 29*d* and with one flange having an opening adapted to receive the bolt 29*d* at the other end 29*b* of the steering rod 29. The axes of the connection bolts 29*c*, 29*d* are parallel to the first pivot axis P1 and thus also to the second pivot axis P2. In a top view (see FIG. 7), the first pivot axis P1 and the axis of the first connection bolt 29*c* are offset and the second pivot axis P2 and the axis of the second connection bolt 29*d* are offset. The offsets are selected such that, with appropriately adjusted lengths of pivot arm 30 and steering rod 29, the orientation of the hopper 61 (around a longitudinal axis (direction) through the discharge opening 61*d* parallel to the first pivot axis P1) remains essentially the same (does not change) when the pivot arm 30 is pivoted between the parking position (FIGS. 6A-6C) and the operating position (FIGS. 7A-7D).

The pivot arm 30 has an adjustable length in order to be able to adjust the distance between the device center C, which is determined by the attachment position to the electric arc furnace 1, and the tap hole 12. One possibility for implementing such an adjustable length is a telescope design. Other possibilities are for example adding or removing sections or adjustable connection positions to the bearings, and so on. The pivot arm 30 of the first embodiment has a telescope design with two hollow bar/beam parts 35, 36 having different diameters, wherein one bar/beam part 35 having the smaller diameter is inserted into the other bar/beam parts 36 having the larger diameter to allow telescopic shifting, and with a telescope lock 37, such as one or more bolts or screws fixing the connection between the two hollow bar/beam parts 35, 36.

With the tap hole filling device 20 according to this design mounted at (on) the electric arc furnace 1 and with an appropriately set length of the pivot arm 30, the discharge opening (dispensing opening) 61*d* of the refractory filling material dispenser 60 attached to the end portion 31 of the pivot arm 30 is vertically above the tap hole 12, when the pivot arm 30 is in the operating position (FIGS. 7A-7D), and refractory filling material dispensed from the discharge dispensing opening 61*d* is falling into the tap hole 12. The pivot position of the pivot arm 30 in the operating position can be determined and the pivoting movement limited without sensors or other devices for measuring/detecting the position of the pivot arm by an adjustable stopper 44 at the pivot carrier 24. Analogously the pivot position of the pivot arm 30 in the parking position (FIGS. 6A-6C) can be determined and the pivoting movement limited without sensors or other devices for measuring/detecting the position of the pivot arm by an adjustable stopper at the pivot carrier 24.

Figure 8:
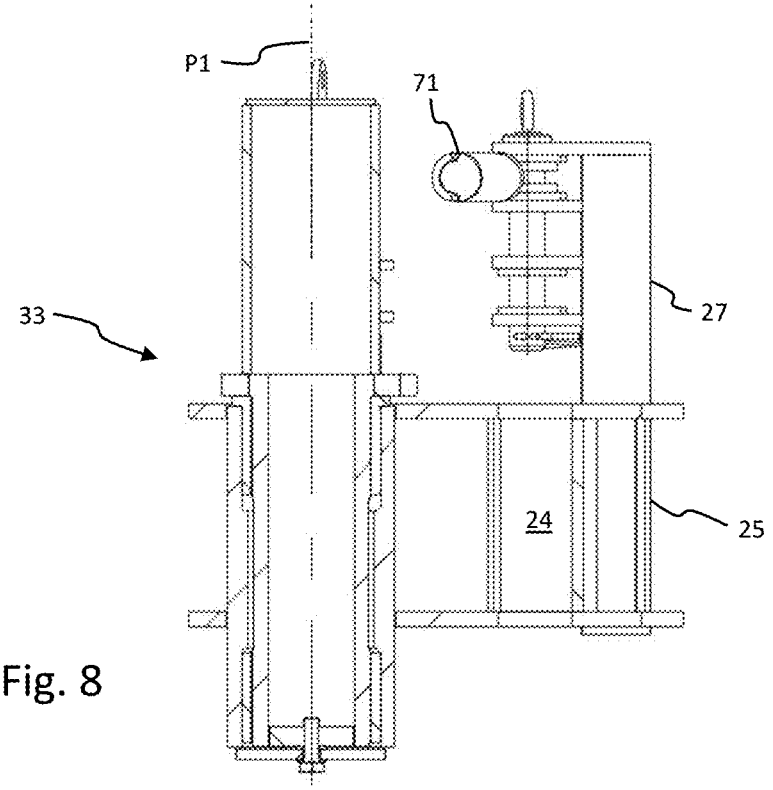
FIG. 8 shows a partly cut away view of the first embodiment of the device for filling a tap hole of an electric arc furnace with refractory filling material of FIGS. 5 to 7 along line A-A shown in FIG. 7B.
Figure 9:
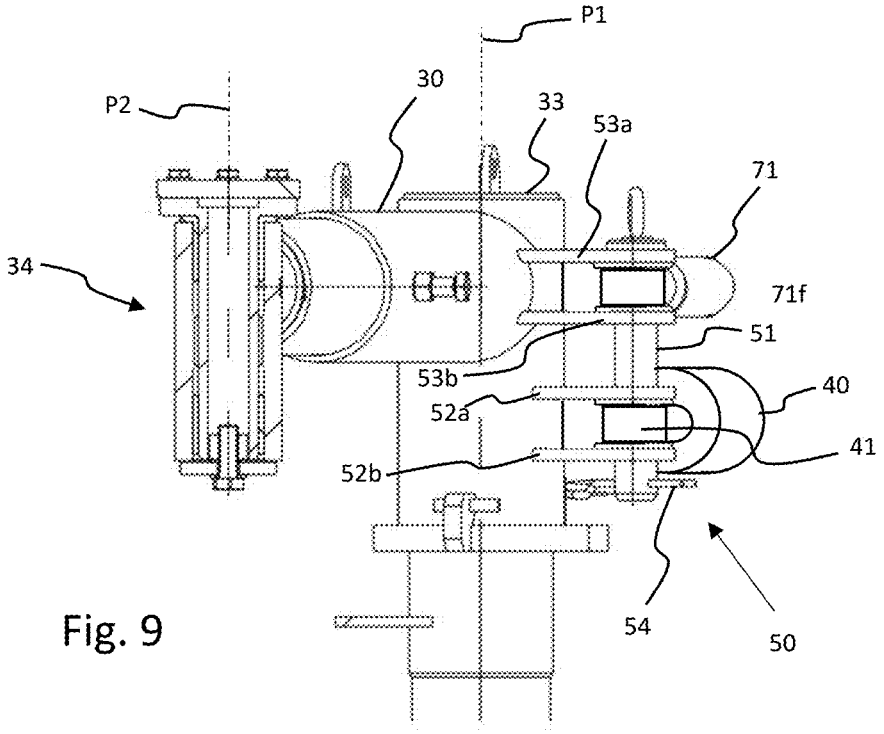
FIG. 9 shows a partly cut away view of the first embodiment of the device for filling a tap hole of an electric arc furnace with refractory filling material of FIGS. 5 to 7 along line B-B shown in FIG. 7B.

The first and second pivot bearings 33, 34 are preferably implemented as low maintenance slide bearings as shown in FIGS. 8 and 9.

At (on) the lateral side of the upper part of the hopper 61 opposite to the lateral side 61*a* of the upper part of the hopper 61, to which to which the pivot arm 30 is connected, a handle 62 is attached, as can be seen, e.g., in FIG. 6B. This handle 62 may be grasped to move the dispenser 60 with the pivot arm 30, in order to perform a manual tap hole filling operation.

As it is clear from the above description, the tap hole filling device 20 according to this design mounted at (on) the electric arc furnace 1 is designed to be operated in an automatic mode controlled by the control system CS of the electric arc furnace under normal operating conditions. However, if there is any problem with the automatic mode, this design enables a very quick change to a manual operation mode, because it is only necessary to manually move the bolt 51, which is one example of the connector, from the connecting position to the disconnected position. Therefore, a manually operated filling operation of the tap hole 12 can be performed, thereby reducing tap-to-tap-time losses due to system failures in a very hostile work environment.

Figure 12:
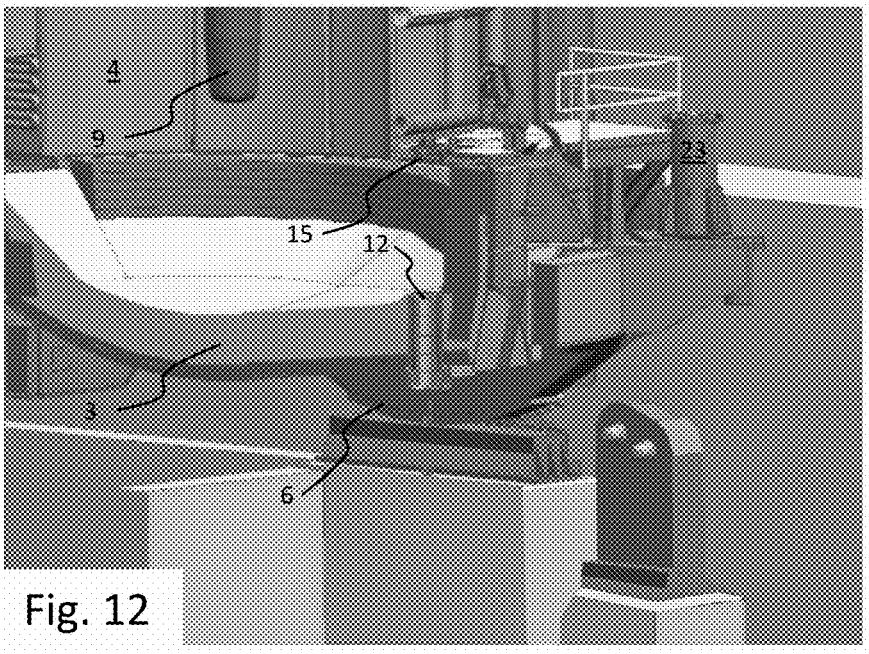
FIG. 12 shows a partly cross-sectional view of an electric arc furnace of the type shown in FIGS. 1 to 4 with an example of a pivot console attached to the cradle.
Figure 7D:
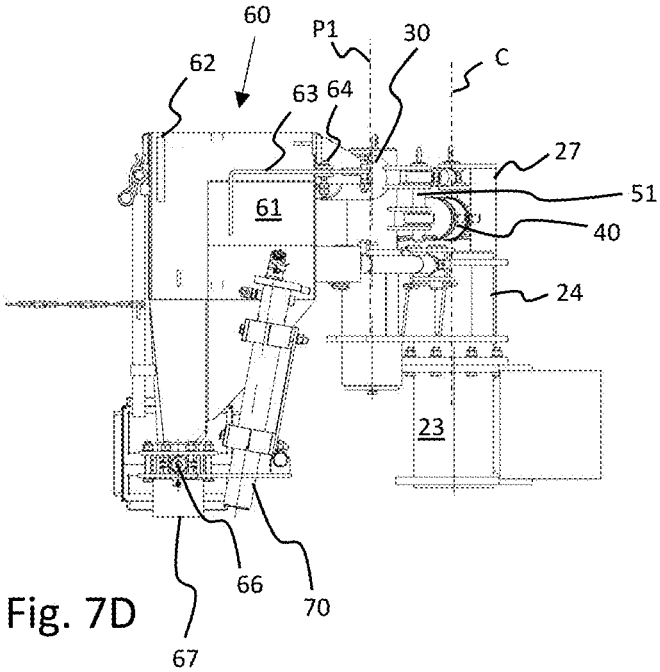

The tap hole filling device 22 with the pivot console 23 is configured to be connected to the electric arc furnace 1 in (at) a position offset from the bay cover opening 15 and the bay cover opening lid 16 and with the first pivot axis P1 located closer to a center of the furnace vessel 2 than the device center axis C in a top view of the furnace vessel 2. Preferably, the pivot console 23 is configured to be connected to the electric arc furnace 1 at the cradle 6. FIG. 12 shows an example of a pivot console 23 attached at the cradle 6. Alternatively, the pivot console 23 could be attached at the furnace vessel 2 such as for example on the bay cover 14 or at the lower furnace vessel 3 or at an upper furnace vessel 4. However, the attachment at the cradle 6 is preferred, because the tap hole filling device 22 does not need to be dismounted when the furnace vessel is exchanged.

In the first embodiment, the longitudinal axis L1 of the tap hole 12 and the center axis C and thus also the first and second pivot axes P1 and P2 are parallel and vertical in a horizontal (untilted) state of the electric arc furnace 1. Due to the usual diameters of the tap hole 12, an inclination angle between the longitudinal axis L1 of the tap hole 12 and the center axis C in the range up to ±10° is acceptable. In such a case, the granular refractory filling material (sand) S discharged vertically above the upper opening of the tap hole 12 will completely fill up the tap hole 12 without voids despite the inclination.

The tap hole filling device 22 optionally comprises a bias spring mechanism 71 having two (first and second) ends 71*a*, 71*b*. One (first) end 71*a* of the bias spring mechanism 71 is attached to the support 27 of the pivot carrier 24 by a bolt-flange as described above with respect to the steering rod 29. The other (second) end 71*b* of the bias spring mechanism 71 is attached to the actuator link mechanism 50 by a bolt-flange as described above with respect to the steering rod 29, wherein the bolt is the bolt 51 of the actuator link mechanism 50. The bias spring mechanism 71 includes a compression spring or the like exerting an adjustable pulling force between the ends of the bias spring mechanism 71. This optional bias spring mechanism 71 provides a big advantage in case of problems during a manual tap hole filling operation.

As was described above, after tapping, which is done by gradually tilting the furnace vessel forward, the furnace vessel is usually tilted back to the tilted-back position as quickly as possible at the end of a tapping process. Such a tilted-back position usually has an inclination angle in a range from 5° to 10° but could also be up to 18°. In the EAF 1 of FIGS. 1 to 4 as in most EAF designs with EBT, if it is operated with "sump", such a tilted-back position is required to avoid that molten mass of the sump reaches the tap hole 12 after tapping is finalized.

If a manual operation of the tap hole filling device 20 becomes necessary in such a back-tilted state of the electric arc furnace 1, the additional force generated by the mass of the refractory filling material (sand) S filled in the hopper 61 due to the inclination angle of the furnace and thus of the pivot axis P1, will support a manual movement of the filled dispenser 60 from the parking position to the operating position. If, however, the manual filling operation cannot be initiated or completed after the filled dispenser 60 was moved from the parking position to the operating position, this force will work against a movement from operating position back to the parking position. The bias spring force of the bias spring mechanism 71 is set such that the amount of the bias spring force corresponds to the amount of the additional force generated by the mass of the refractory filling material (sand) S filled in the hopper 61 to enable the return to the parking position by manual operation despite the mass of the refractory filling material (sand) S still present in the hopper 61. Therefore, this bias spring mechanism is a very useful option in case the tap hole filling is to be effected in a back tilted position of the furnace.

As was described above, after tapping the molten metal and filling the tap hole with refractory filling material, the EAF 1 is again charged with material to be molten, such as scrap metal. For this purpose, the lid 5 and the electrodes 9 must be lifted and pivoted away from the upper opening of the furnace vessel. This is effected with the gantry G shown on the left side in FIG. 2. The lid 5 and the electrodes 9 are pivoted away from the upper opening of the furnace vessel to the same side on which the tap hole 12 is located in usual EAF designs, i.e., to the lower left side in FIG. 1. In this situation, it is likely that very hot debris will fall down from the lid and/or the electrodes and the heat radiation from the lower side of the lid 5 and the electrodes 9 moved close to this region is very strong. In addition to the debris and heat caused by the tapping, this is another reason why the region, in which the tap hole filling device 20 needs to be mounted, is an even more hostile environment than the environment of an electric arc furnace is.

As already stated above, the movement of the pivot arm 30 having the dispenser 60 between the parking position and the operating position effected by the operation of the pivot arm actuator 40 is performed in an automatic mode under control by (of) the control system CS. The same applies to the discharging of the refractory filling material (sand) S filled in the hopper 61 and the recharging of the hopper, etc. The control system CS preferably includes an operation button control, which enables a remote adjustment of the position of the hopper 61 above the tap hole 12 by manually actuating control elements such as buttons or a control stick or display elements that control the pivot arm actuator 40 to move and thus enable a remotely adjustment of the position of the hopper 61 in case of positioning problems without having to fully deactivate the automatic mode. This operation button control can be located with the control system CS in the control room (FIG. 1) and/or can be implemented as a hand-held control device or can be implemented as a remote control desk or the like remote from the control room and remote from the tap hole filling device 20.

According to this embodiment of the present teachings, a method for filling a tap hole of an electric arc furnace 1 with refractory filling material S comprises:

a) operating the tap hole filling device 20 in an automatic mode under control of the control system CS with the connector 51 of the actuator link mechanism 50 in the connecting position, b) stopping the operation of the tap hole filling device 20 in the automatic mode, if a problem of moving the pivot arm 30 is detected (in response to detection of movement of the pivot arm 30), and setting the control to a manual mode, which includes interrupting the supply of power (e.g., electric current, pressurized fluid, etc.) to the pivot arm actuator 40, c) moving the connector 51 by manual (or powered) actuation from the connecting position to the disconnected position, in (at) which (where) the connector does not connect the pivot arm 30 and the pivot arm actuator 40, d) positioning the refractory filling material dispenser 60 attached to the one end portion 31 of the pivot arm 30 such that the discharge (dispensing) opening 61*d* is vertically above the tap hole 12, e) dispensing refractory filling material S from the discharge opening 61*d* into the tap hole 12 to fill the same, and f) moving the refractory filling material dispenser 60 with the pivot arm 30 back to the parking position.

In step a), it is advantageous in the above-described first embodiment that the filling operation can be remotely monitored using the camera 70.

In step a), it is advantageous in the above-described first embodiment, if the automatic positioning of the refractory filling material dispenser 60 does not result in that the discharge (dispensing) opening 61*d* is precisely positioned vertically above the tap hole 12, to first try to adjust the positioning using the operation button control described above. This operation button control enables attempts to remotely adjust the position without requiring a human to enter the very hostile environment around the EAF close to the tap hole filling device 20. Only if the position of the refractory filling material dispenser 60 cannot by adjusted using the operation button control, then it becomes necessary to proceed to step b).

In step b), it is advantageous in the above-described first embodiment, to first interrupt the power supply to the actuator. For example, if the actuator is a hydraulic cylinder as in the first embodiment, it is important to cut off the hydraulic pressure supply by closing the respective valve(s).

In step c), it is especially advantageous to first remove the spring cotter 54, then move the bolt 51 upwards, for example by pulling a hook inserted through the ring 510 or by using the lever inserted between the top flange 53*a* of the actuator link mechanism 50 and the flange 51*f* of the bolt 51 or the like, until the bolt 51 is pulled out of the flange 41 of the cylinder. Then the flange 41 of the cylinder 40 is moved to the side and the bolt 51 is pulled down again and secured with the spring cotter 54.

In step d), depending on whether the discharge hole is correctly positioned above the tap hole 12 by manual movement of the dispenser 60 into the operation position, which can be assumed to be reached, when the stopper 44 is in abutment, and can be checked with the camera 70, or not, the additional adjustment possibilities with slide 90 and/or deflector 67 can be optionally used, if necessary.

If necessary, the removable securing bolt 64 of the toggle joint 28 is removed to enable the dispenser 60 to be shifted (moved) in the essentially horizontal shift direction AD, thereby allowing the position of the dispensing opening 61*d* to be adjusted (moved) to be vertically above the tap hole 12 in the dispenser slide 90 with the toggle lever 63. The correct positioning can be monitored/checked using the camera 70 attached to the dispenser 60.

Thereafter, in step e), the dispensing can be monitored using the camera 70 attached to the dispenser 60.

Figure 11A:
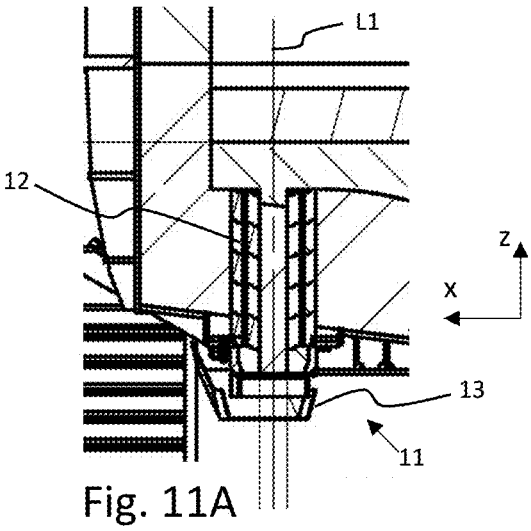
FIG. 11A shows an enlarged view of the tap hole in FIG. 3 before filling with refractory filling material.
Figure 11B:
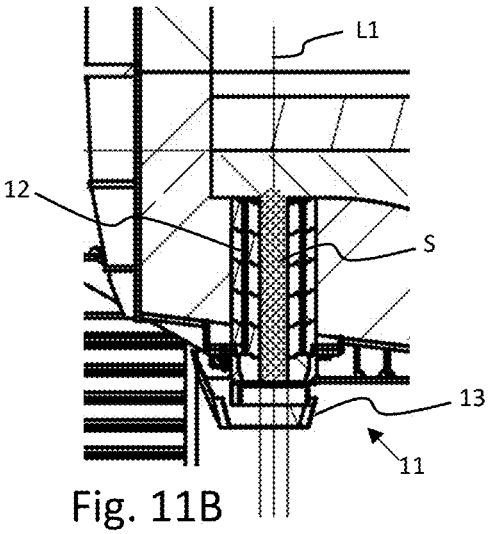
FIG. 11B shows an enlarged view of the tap hole in FIG. 3 after filling with refractory filling material.

FIGS. 11A and 11B show an enlarged view of the tap hole in FIG. 3 before and after filling with refractory filling material S.

The tap hole filling device 20 could comprise transducers (sensors) which are used to record the distances covered during the pivoting movement of the pivot arm 30 and the mass and/or volume of refractory material dispensed into and from the dispenser 60. In such a case, the data are output to a control system CS, which is not shown in detail but is located in the control room shown in FIG. 1. However, due to the very hostile environment, it is preferred, as implemented in the first embodiment, to use manual control elements such as stoppers and to enable manual actuation such as manually pulling the bolt 51 in order to avoid as much as possible that additional problems could occur if the tap filling process has to be switched to manual operation for any reason.

The control system may comprise a processor, memory with executable programs stored therein, I/O ports, etc., as will be described further below.

It is explicitly emphasized that all features disclosed in the description and/or claims are to be considered separate and independent from each other for the purpose of the original disclosure as well as for the purpose of limiting the claimed invention regardless of the combinations of features in the embodiments and/or claims. It is explicitly stated that all range indications or indications of groups of units disclose any possible intermediate value or subgroup of units for the purpose of the original disclosure as well as for the purpose of limiting the claimed invention, in particular also as a limit of a range indication.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in con-junction with other features and teachings to provide improved tap hole filling devices, electric arc furnaces and methods of filling the tap hole of the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

Although some aspects of the present disclosure have been described in the context of a device, it is to be understood that these aspects also represent a description of a corresponding method, so that each block or component of a device, such as the control system, is also understood as a corresponding method step or as a feature of a method step. In an analogous manner, aspects which have been described in the context of or as a method step also represent a description of a corresponding block or detail or feature of a corresponding device, such as the control system.

Depending on certain implementation requirements, exemplary embodiments of the control system of the present disclosure may be implemented in hardware and/or in software. The implementation can be configured using a digital storage medium, for example one or more of a ROM, a PROM, an EPROM, an EEPROM or a flash memory, on which electronically readable control signals (program code) are stored, which interact or can interact with a programmable hardware component such that the respective method is performed.

A programmable hardware component can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the control system, are implemented as a program, firmware, computer program, or computer program product including a program, or as data, wherein the program code or the data is operative to perform one of the methods if the program runs on a processor or a programmable hardware component. The program code or the data can for example also be stored on a machine-readable carrier or data carrier. The program code or the data can be, among other things, source code, machine code, bytecode or another intermediate code.

A program according to an exemplary embodiment can implement one of the methods during its performing, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes using the control system, hydraulic cylinders, etc.

Therefore, although some aspects of the control system have been identified as "parts" or "units" or "steps", it is understood that such parts or units or steps need not be physically separate or distinct electrical components, but rather may be different blocks of program code that are executed by the same hardware component, e.g., one or more microprocessors.

The following aspects of the present teachings are also generally disclosed herein:

1. A tap hole filling device for filling a tap hole of an electric arc furnace (1) with refractory filling material (S), the electric arc furnace comprising a furnace vessel (2) that includes a furnace lower vessel (3) having an eccentric or offset bottom tap hole (12) extending along a first longitudinal axis (L1) in a furnace vessel bay (10) covered by a bay cover (14) comprising an bay cover opening (15) above the bottom tap hole (12) and a bay cover opening lid (16), a furnace tilting device comprising a cradle (6), on which the furnace vessel is supported, configured to tilt the furnace vessel relative to a horizontal direction of a foundation (7) that supports the electric arc furnace, a tap hole gate (13) configured to open and close the tap hole (12) at its bottom side, and a control system (CS) configured to control the operation of the electric arc furnace, the tap hole filling device (20) comprising:

a pivot arm (30) configured to be pivoted between a parking position and an operating position, a pivot arm actuator (40), an actuator link mechanism (50) selectively connecting the pivot arm (30) and the pivot arm actuator (40) such that the pivot arm actuator (40) is configured to pivot the pivot arm (30) between the parking position and the operating position, when connected via the actuator link mechanism, and a refractory filling material dispenser (60) having a dispensing opening (61*d*) at (on) its bottom side and attached to one (first) end portion (31) of the pivot arm (30) and configured to dispense refractory filling material (S) from the dispensing opening, wherein:

the refractory filling material dispenser (60) is attached to the end portion (31) of the pivot arm such that the dispensing opening (61*d*) is vertically above the tap hole (12), when the pivot arm (30) is in the operating position, and refractory filling material dispensed from the dispensing opening is falling into the tap hole, and the actuator link mechanism (50) comprises a connector (51) for selectively connecting the pivot arm (30) and the pivot arm actuator (40), the connector (51) being moveable by manual or powered actuation between a connecting position, in which the connector connects the pivot arm (30) and the pivot arm actuator (40) such that the pivot arm actuator (40) is configured to pivot the pivot arm (30) between the parking position and the operating position, and a disconnected position, in which the connector does not connect the pivot arm (30) and the pivot arm actuator (40).

2. The tap hole filling device according to the above-described aspect 1, further comprising:

a pivot mechanism (22) comprising a pivot console (23) configured to be connected to the electric arc furnace (1) and a pivot carrier (24) having a first end (25) and a second end (26) and connected to the pivot console (23) with a device center axis (C) located between the first end (25) and the second end (26) of the pivot carrier (24), wherein the pivot arm (30) is pivotably connected at its other (second) end portion (32) to the pivot carrier (24) to pivot around a first pivot axis (P1), which is parallel to the device center axis (C) and is located at the first end (25) of the pivot carrier (24), wherein the pivot carrier (24) comprises a support (27) at its second end (26) to which the pivot arm actuator (40) is attached, and wherein the actuator link mechanism (50) is attached to the other (second) end portion (32) of the pivot arm (30) such the pivot arm actuator (40) can selectively connected with and disconnected from the pivot arm (30) by moving the connector (51) between the connecting position and the disconnected position.

3. The tap hole filling device according to the above-described aspect 2, further comprising a bias spring mechanism (71) having two ends (71*a*, 71*b*) and being attached with one (71*a*) of its ends to the support (27) of the pivot carrier (24) and being selectively connected to the actuator link mechanism (50) with the other (71*b*) of its ends via the connector (51).

4. The tap hole filling device according to the above-described aspect 2 or 3, further comprising adjustable stoppers (44, 45) at (on) the pivot carrier (24) for limiting the pivoting movement of the pivot arm (30) to the parking and operating positions.

5. The tap hole filling device according to any one of the above-described aspects 2 to 4, wherein the pivot console (23) is configured to be connected to the electric arc furnace (1) in (at) a position offset from the bay cover opening (15) and the bay cover opening lid (16) and with the first pivot axis (P1) located closer to a center of the furnace vessel (2) than the device center axis (C) in a top view of the furnace vessel (2).

6. The tap hole filling device according to any one of the above-described aspects 2 to 5, wherein the pivot console (23) is configured to be connected to the electric arc furnace (1) at the cradle (6), on which the furnace vessel is supported, or at the furnace vessel (2) such as for example on the bay cover (14) or at the lower furnace vessel (3) or at an upper furnace vessel (4).

7. The tap hole filling device to any one of the above-described aspects 2 to 6, further comprising:

a steering rod (29) having an adjustable length between its ends (29*a*, 29*b*) and being rotatably supported with one (29*a*) of its ends connected to the pivot carrier (24) and with the other (29*b*) of its ends connected to the dispenser (60), the rotational axes thereof being parallel to the first pivot axis, wherein the length of the steering rod (29) is adjusted such that the dispenser orientation is not changed when the pivot arm (30) is pivoted between the parking position and the operating position.

8. The tap hole filling device according to any one of the above-described aspects 1 to 7, further comprising:

a toggle lever (63), and a toggle joint (28) connected between the toggle lever (63) and a linear dispenser slide (90) for shifting (moving) the dispenser (60) in a shift direction (AD) perpendicular to the first pivot axis (P1), wherein the toggle joint (28) comprises a removable securing bolt (64) which, when present, locks the toggle joint (28), and which when removed, releases the movement of the toggle joint (28), thereby enabling the position of the dispensing opening (61*d*) to be adjusted (moved) vertically above the tap hole (12) by shifting (moving) the dispenser in the linear dispenser slide (90) with (using) the toggle lever (63).

9. The tap hole filling device according to any one of the above-described aspects 1 to 8, wherein the actuator link mechanism (50) comprises a bolt (51) as the connector and flanges (52*a, b*) with openings configured to receive the bolt (51), and the pivot arm actuator (40) comprises a flange (41) with an opening configured to receive the bolt (51) such that, when the bolt is received by the flanges (52*a*, 52*b*, 41) of the actuator link mechanism (50) and of the pivot arm actuator (40), the pivot arm (30) and the pivot arm actuator (40) are connected.

10. The tap hole filling device according to any one of the above-described aspects 1 to 9, wherein the pivot arm actuator (40) is connected to and controlled by the control system (CS) of the furnace to pivot the pivot arm (30) between the parking position and the operating position in an automatic operation mode and to lock the pivot arm actuator (40) to keep the pivot arm (30) in the parking position in a manual operation mode.

11. An electric arc furnace comprising:

a furnace vessel (2) that includes a furnace lower vessel (3) having an eccentric or offset bottom tap hole (12) extending along a first longitudinal axis (L1) in a furnace vessel bay (10), a bay cover (14) covering the furnace vessel bay (10) and comprising a bay cover opening (15) above the bottom tap hole (12) and a bay cover opening lid (16) for opening and closing the bay cover opening (15), a furnace tilting device comprising a cradle (6), on which the furnace vessel is supported, and configured to tilt the furnace vessel relative to a horizontal direction of a foundation (7) that supports the electric arc furnace, a tap hole gate (13) configured to open and close the tap hole (12) at (on) its bottom side, a control system (CS) configured to control the operation of the electric arc furnace, and the tap hole filling device (20) according to any one of the above-described aspects 1 to 10, wherein the tap hole filling device (20) is connected to the electric arc furnace vessel (1) in (at) a position offset from the bay cover opening (15) and the bay cover opening lid (16), wherein the bay cover opening lid (16) is configured to be opened and closed under the control of the control system (CS), and wherein the tap hole filling device (20) is connected to and controlled by the control system (CS) to pivot the pivot arm (30) between the parking position and the operating position in an (the) automatic operation mode and to lock the pivot arm actuator (40) to keep the pivot arm (30) in the parking position in a (the) manual operation mode.

12. The electric arc furnace of the above-described aspect 11, further comprising a camera (70) attached to the dispenser (60) in (at) a position adjusted such that the camera (70) images (captures one or more images of) the tap hole (12) through the bay cover opening (15) with the bay cover opening lid (16) open when (while) the pivot arm (30) is in the operating position.

13. A method for filling a tap hole of an electric arc furnace (1) with refractory filling material (S), the electric arc furnace comprising:

a furnace vessel (2) that includes a furnace lower vessel (3) having an eccentric or offset bottom tap hole (12) extending along a first longitudinal axis (L1) in a furnace vessel bay (10), a bay cover (14) covering the furnace vessel bay (10) and comprising a bay cover opening (15) above the bottom tap hole (12) and a bay cover opening lid (16) for opening and closing the bay cover opening (15), a furnace tilting device comprising a cradle (6), on which the furnace vessel is supported, and configured to tilt the furnace vessel relative to a horizontal direction of a foundation (7) that supports the electric arc furnace, a tap hole gate (13) configured to open and close the tap hole (12) at (on) its bottom side, a control system (CS) configured to control the operation of the electric arc furnace, and the tap hole filling device (20) according to any one of the above-described aspects 1 to 10, wherein the tap hole filling device (20) is connected to the electric arc furnace (1) in (at) a position offset from the bay cover opening (15) and the bay cover opening lid (16), wherein the bay cover opening lid (16) is configured to be opened and closed under the control of the control system (CS), and wherein the tap hole filling device (20) is connected to and controlled by the control system (CS) to pivot the pivot arm (30) between the parking position and the operating position in an (the) automatic operation mode and to lock the pivot arm actuator (40) to keep the pivot arm (30) in the parking position in a (the) manual operation mode, the method comprising:

a) operating the tap hole filling device (20) in an (the) automatic mode under control of the control system (CS) with the connector (51) of the actuator link mechanism (50) in the connecting position, b) stopping the operation of the tap hole filling device (20) in the automatic mode, if a problem of moving the pivot arm (30) is detected (in response to detection of movement of the pivot arm (30), and setting the control to a manual mode, which includes interrupting a supply of power (e.g., electric current, pressurized fluid, etc.) to the pivot arm actuator (40), c) moving the connector (51) by manual or powered actuation from the connecting position, in (at) which (where) the connector connects the pivot arm (30) and the pivot arm actuator (40) such that the pivot arm actuator (40) is configured to pivot the pivot arm (30) between the parking position and the operating position, to the disconnected position, in (at) which (where) the connector does not connect the pivot arm (30) and the pivot arm actuator (40), d) positioning the refractory filling material dispenser (60) attached to the end portion (31) of the pivot arm such that the dispensing opening (61*d*) is vertically above the tap hole (12), e) dispensing refractory filling material (S) from the dispensing opening (61*d*) into the tap hole (12) to fill the same, and f) moving the refractory filling material dispenser (60) with the pivot arm (30) to the parking position.

14. The method according to the above-described aspect 13, wherein step d) includes:

removing a removable securing bolt (64) of a toggle joint (28) connected between a toggle lever (63) and a linear dispenser slide (90) to shift (move) the dispenser (60) in a shift direction (AD), which removable securing bolt (64), when present, locks the toggle joint (28), and, when removed, releases the movement of the toggle joint (28), thereby enabling the position of the dispensing opening (61*d*) to be adjusted vertically above the tap hole (12) by shifting the dispenser in the linear dispenser slide (90) with (using) the toggle lever (63), and adjusting the position of the dispensing opening (61*d*) vertically above the tap hole (12) by moving the dispenser using the toggle lever (63) and/or a handle (62) provided at (on) and/or connected to the dispenser (60).

15. The method according to the above-described aspect 13 or 14, wherein:

step d) includes monitoring the positioning of the dispenser (60) using a camera (70) attached to the dispenser (60) to determine whether the dispensing opening (61*d*) is vertically above the tap hole (12), and step e) includes monitoring the dispensing using the camera (70) attached to the dispenser (60).

16. A tap hole filling device for filling an eccentric or offset bottom tap hole of an electric arc furnace (1) with refractory filling material (S), comprising:

a pivot arm (30) configured to be pivoted between a parking position and an operating position, a pivot arm actuator (40), an actuator link mechanism (50) selectively connecting the pivot arm (30) and the pivot arm actuator (40) such that the pivot arm actuator (40) is configured to pivot the pivot arm (30) between the parking position and the operating position, when connected via the actuator link mechanism, and a refractory filling material dispenser (60) having a dispensing opening (61*d*) at its bottom side and attached to one (first) end portion (31) of the pivot arm (30) and configured to dispense refractory filling material (S) from the dispensing opening, when the pivot arm (30) is in the operating position, wherein the actuator link mechanism (50) comprises a connector (51) for selectively connecting the pivot arm (30) and the pivot arm actuator (40), the connector (51) being moveable by manual or powered actuation between a connecting position, in (at) which (where) the connector (51) connects the pivot arm (30) and the pivot arm actuator (40) such that the pivot arm actuator (40) is configured to pivot the pivot arm (30) between the parking position and the operating position in an automatic operation mode, and a disconnected position, in (at) which (where) the connector (51) does not connect the pivot arm (30) and the pivot arm actuator (40) to enable a manual operation mode.

17. The tap hole filling device of aspect 16, further comprising the features of any one or more of the above-described aspects 2 to 10.

We claim:

1. A tap hole filling device for filling a tap hole of an electric arc furnace with refractory filling material, the electric arc furnace comprising a furnace vessel that includes a furnace lower vessel having an eccentric or offset bottom tap hole extending along a first longitudinal axis (L1) in a furnace vessel bay covered by a bay cover comprising a bay cover opening above the bottom tap hole and a bay cover opening lid, a furnace tilting device comprising a cradle, on which the furnace vessel is supported, configured to tilt the furnace vessel relative to a horizontal direction of a foundation that supports the electric arc furnace, a tap hole gate configured to open and close a bottom side of the tap hole, and a control system configured to control operation of the electric arc furnace, the tap hole filling device comprising:

a pivot arm configured to be pivoted about a first pivot axis between a parking position and an operating position, a pivot arm actuator, an actuator link mechanism selectively connecting the pivot arm and the pivot arm actuator such that, when connected via the actuator link mechanism, the pivot arm actuator is configured to pivot the pivot arm between the parking position and the operating position, and a refractory filling material dispenser including a hopper having a dispensing opening at or on a bottom side of the hopper, the refractory filling material dispenser being configured to dispense refractory filling material from the dispensing opening, wherein:

the hopper has a shape tapering in a longitudinal direction that extends through the dispensing opening, the longitudinal axis of the hopper being parallel to the first pivot axis, the refractory filling material dispenser is attached to a first end portion of the pivot arm such that the dispensing opening is vertically above the tap hole while the pivot arm is in the operating position and the refractory filling material dispensed from the dispensing opening is falling into the tap hole, and the actuator link mechanism comprises a connector for selectively connecting the pivot arm and the pivot arm actuator, the connector being movable by manual or powered actuation between a connecting position, where the connector connects the pivot arm and the pivot arm actuator such that the pivot arm actuator is configured to pivot the pivot arm between the parking position and the operating position, and a disconnected position, where the connector does not connect the pivot arm and the pivot arm actuator.

2. The tap hole filling device according to claim 1, further comprising:

a toggle lever, a toggle joint connected between the toggle lever and a linear dispenser slide configured to shift the dispenser in a shift direction perpendicular to the first pivot axis, wherein the toggle joint comprises a removable securing bolt which, when present, locks the toggle joint, and which when removed, permits movement of the toggle joint to adjust the position of the dispensing opening vertically above the tap hole by shifting the dispenser in the linear dispenser slide using the toggle lever.

3. The tap hole filling device according to claim 1, wherein the actuator link mechanism comprises a powered actuator configured to move the connector between the connecting position and the disconnected position.

4. The tap hole filling device according to claim 1, wherein the pivot arm actuator is connected to and controllable by the control system of the electric arc furnace to pivot the pivot arm between the parking position and the operating position in an automatic operation mode and to lock the pivot arm actuator to keep the pivot arm in the parking position in a manual operation mode.

5. An electric arc furnace comprising:

a furnace vessel that includes a furnace lower vessel having an eccentric or offset bottom tap hole extending along a first longitudinal axis in a furnace vessel bay, a bay cover covering the furnace vessel bay and comprising a bay cover opening above the bottom tap hole and a bay cover opening lid for opening and closing the bay cover opening, a furnace tilting device comprising a cradle, on which the furnace vessel is supported, and configured to tilt the furnace vessel relative to a horizontal direction of a foundation that supports the electric arc furnace, a tap hole gate configured to open and close a bottom side of the tap hole, a control system configured to control operation of the electric arc furnace, and the tap hole filling device according to claim 1, wherein:

the tap hole filling device is connected to the electric arc furnace at a position offset from the bay cover opening and the bay cover opening lid, the bay cover opening lid is configured to be opened and closed under the control of the control system, and the pivot arm actuator is connected to and controllable by the control system to pivot the pivot arm between the parking position and the operating position in an automatic operation mode and to lock the pivot arm actuator to keep the pivot arm in the parking position in a manual operation mode.

6. The electric arc furnace of claim 5, wherein the tap hole filling device further comprises:

a pivot mechanism comprising a pivot console connected to the electric arc furnace at the position offset from the bay cover opening and the bay cover opening lid, and a pivot carrier having a first end and a second end and connected to the pivot console with a device center axis located between the first end and the second end of the pivot carrier, wherein:

a second end portion of the pivot arm is pivotably connected to the pivot carrier via a bearing so as to be pivotable around a first pivot axis, which is parallel to and offset from the device center axis and is located at the first end of the pivot carrier, the pivot carrier comprises a support at the second end to which the pivot arm actuator is attached, and the actuator link mechanism is attached to the second end portion of the pivot arm such the pivot arm actuator is selectively connectable with and disconnectable from the pivot arm by moving the connector between the connecting position and the disconnected position.

7. The electric arc furnace of claim 6, wherein:

the actuator link mechanism comprises a bolt serving as the connector and flanges having openings configured to receive the bolt, the pivot arm actuator comprises a flange having an opening configured to receive the bolt such that, while the bolt is received by the flanges of the actuator link mechanism and of the pivot arm actuator, the pivot arm and the pivot arm actuator are connected, and the tap hole filling device further comprises:

a bias spring mechanism having first and second ends, the first end being attached to the support of the pivot carrier and the second end being selectively connectable, via the connector, to the actuator link mechanism, a steering rod having an adjustable length between first and second ends of the steering rod, the first end being rotatably supported with respect to the pivot carrier about a first rotational axis, the second end being rotatably supported with respect to the dispenser about a second rotational axis, the first and second rotational axes being parallel to the first pivot axis, and the length of the steering rod being adjustable such that an orientation of the dispenser does not change in response to pivoting of the pivot arm between the parking position and the operating position, a toggle lever, and a toggle joint connected between the toggle lever and a linear dispenser slide configured to shift the dispenser in a shift direction perpendicular to the first pivot axis (P1), wherein the toggle joint comprises a removable securing bolt which, when present, locks the toggle joint, and which when removed, permits movement of the toggle joint to adjust the position of the dispensing opening vertically above the tap hole by shifting the dispenser in the linear dispenser slide using the toggle lever.

8. The electric arc furnace of claim 5, further comprising:

a camera attached to the dispenser at a position adjusted such that the camera is positioned to capture an image of the tap hole through the bay cover opening with the bay cover opening lid open while the pivot arm is in the operating position.

9. The tap hole filling device of claim 1, further comprising:

a steering rod extending in parallel with the pivot arm, wherein:

the steering rod has a first end connected to the refractory filling material dispenser and a second end connected to a fixed location that does not move while the pivot arm is pivoting between the parking position and the operating position, and a length of the steering rod between the first end and the second end is adjustable such that an orientation of the dispenser does not change in response to pivoting of the pivot arm between the parking position and the operating position.

10. The tap hole filling device of claim 1, wherein the pivot arm comprises a telescoping arm.

11. The tap hole filling device of claim 1, wherein:

the refractory filling material dispenser is attached to the first end portion of the pivot arm via a pivot bearing having a second pivot axis (P2), and the second pivot axis (P2) is parallel to the first pivot axis (P1).

12. A method for filling a tap hole of an electric arc furnace with refractory filling material (S), the electric arc furnace comprising:

a furnace vessel that includes a furnace lower vessel having an eccentric or offset bottom tap hole extending along a first longitudinal axis (L1) in a furnace vessel bay, a bay cover covering the furnace vessel bay and comprising a bay cover opening above the bottom tap hole and a bay cover opening lid for opening and closing the bay cover opening, a furnace tilting device comprising a cradle, on which the furnace vessel is supported, and configured to tilt the furnace vessel relative to a horizontal direction of a foundation that supports the electric arc furnace, a tap hole gate configured to open and close a bottom side of the tap hole, a control system configured to control operation of the electric arc furnace, and the tap hole filling device according to claim 1, wherein:

the tap hole filling device is connected to the electric arc furnace on the bay cover at a position offset from the bay cover opening and the bay cover opening lid, the bay cover opening lid is configured to be opened and closed under the control of the control system, and the tap hole filling device is connected to and controllable by the control system to pivot the pivot arm between the parking position and the operating position in an automatic operation mode and to lock the pivot arm actuator to keep the pivot arm in the parking position in a manual operation mode, the method comprising:

a) operating the tap hole filling device in the automatic mode under control of the control system with the connector of the actuator link mechanism in the connecting position, b) in response to detection of movement of the pivot arm, stopping the operation of the tap hole filling device in the automatic mode, and setting the control to the manual mode including interrupting a supply of power to the pivot arm actuator, c) moving the connector by manual or powered actuation from the connecting position, where the connector connects the pivot arm and the pivot arm actuator such that the pivot arm actuator is configured to pivot the pivot arm between the parking position and the operating position, to the disconnected position, where the connector does not connect the pivot arm and the pivot arm actuator, d) positioning the refractory filling material dispenser attached to the first end portion of the pivot arm such that the dispensing opening is vertically above the tap hole, e) dispensing refractory filling material from the dispensing opening into the tap hole to fill the tap hole, and f) moving the refractory filling material dispenser with the pivot arm to the parking position.

13. The method according to claim 12, wherein step d) includes:

removing a removable securing bolt of a toggle joint connected between a toggle lever and a linear dispenser slide configured to shift the dispenser in a shift direction, wherein the removable securing bolt, when present, locks the toggle joint, and, when removed, permits movement of the toggle joint to adjust the position of the dispensing opening vertically above the tap hole by shifting the dispenser in the linear dispenser slide using the toggle lever, and adjusting the position of the dispensing opening vertically above the tap hole by moving the dispenser using the toggle lever and/or a handle provided at or on the dispenser.

14. The method according to claim 12, wherein:

step d) includes monitoring the positioning of the dispenser using a camera attached to the dispenser to determine whether the dispensing opening is vertically above the tap hole, and step e) includes monitoring the dispensing using the camera attached to the dispenser.

15. A tap hole filling device for filling a tap hole of an electric arc furnace with refractory filling material, the electric arc furnace comprising a furnace vessel that includes a furnace lower vessel having an eccentric or offset bottom tap hole extending along a first longitudinal axis (L1) in a furnace vessel bay covered by a bay cover comprising a bay cover opening above the bottom tap hole and a bay cover opening lid, a furnace tilting device comprising a cradle, on which the furnace vessel is supported, configured to tilt the furnace vessel relative to a horizontal direction of a foundation that supports the electric arc furnace, a tap hole gate configured to open and close a bottom side of the tap hole, and a control system configured to control operation of the electric arc furnace, the tap hole filling device comprising:

a pivot arm configured to be pivoted between a parking position and an operating position, a pivot arm actuator, an actuator link mechanism selectively connecting the pivot arm and the pivot arm actuator such that, when connected via the actuator link mechanism, the pivot arm actuator is configured to pivot the pivot arm between the parking position and the operating position, a refractory filling material dispenser having a dispensing opening at or on a bottom side of the refractory filling material dispenser, the refractory filling material dispenser being configured to dispense refractory filling material from the dispensing opening, and a pivot mechanism comprising a pivot console configured to be connected to the electric arc furnace vessel and a pivot carrier having a first end and a second end and connected to the pivot console with a device center axis located between the first end and the second end of the pivot carrier, wherein:

the refractory filling material dispenser is attached to a first end portion of the pivot arm such that the dispensing opening is vertically above the tap hole while the pivot arm is in the operating position and the refractory filling material dispensed from the dispensing opening is falling into the tap hole, the actuator link mechanism comprises a connector for selectively connecting the pivot arm and the pivot arm actuator, the connector being movable by manual or powered actuation between a connecting position, where the connector connects the pivot arm and the pivot arm actuator such that the pivot arm actuator is configured to pivot the pivot arm between the parking position and the operating position, and a disconnected position, where the connector does not connect the pivot arm and the pivot arm actuator, a second end portion of the pivot arm is pivotably connected to the pivot carrier to pivot around a first pivot axis (P1), which is parallel to the device center axis and is located at the first end of the pivot carrier, the pivot carrier comprises a support at the second end to which the pivot arm actuator is attached, and the actuator link mechanism is attached to the second end portion of the pivot arm such that the pivot arm actuator is selectively connectable with and disconnectable from the pivot arm by moving the connector between the connecting position and the disconnected position.

16. The tap hole filling device according to claim 15, wherein:

the actuator link mechanism comprises a bolt serving as the connector and flanges having openings configured to receive the bolt, and the pivot arm actuator comprises a flange having an opening configured to receive the bolt such that, when the bolt is received by the flanges of the actuator link mechanism and of the pivot arm actuator, the pivot arm and the pivot arm actuator are connected.

17. The tap hole filling device according to claim 15, further comprising:

a bias spring mechanism having first and second ends, wherein the first end is attached to the support of the pivot carrier and the second end is selectively connectable, via the connector, to the actuator link mechanism.

18. The tap hole filling device according to claim 15, further comprising:

adjustable stoppers at or on the pivot carrier for limiting the pivoting movement of the pivot arm to the parking and operating positions.

19. The tap hole filling device according to claim 15, further comprising:

a steering rod having an adjustable length between first and second ends of the steering rod, wherein:

the first end is rotatably supported with respect to the pivot carrier about a first rotational axis, the second end is rotatably supported with respect to the dispenser about a second rotational axis, the first and second rotational axes are parallel to the first pivot axis, and the length of the steering rod is adjustable such that an orientation of the dispenser does not change in response to pivoting of the pivot arm between the parking position and the operating position.

20. The tap hole filling device according to claim 15, wherein the pivot console is configured to be connected to the electric arc furnace on the bay cover at a position offset from the bay cover opening and the bay cover opening lid and with the first pivot axis located closer to a center of the furnace vessel than the device center axis in a top view of the furnace vessel.

21. A tap hole filling device for filling an eccentric or offset bottom tap hole of an electric arc furnace with refractory filling material (S), comprising:

a pivot arm configured to be pivoted between a parking position and an operating position, a pivot arm actuator, an actuator link mechanism selectively connecting the pivot arm and the pivot arm actuator such that, when connected via the actuator link mechanism, the pivot arm actuator is configured to pivot the pivot arm between the parking position and the operating position, and a refractory filling material dispenser having a dispensing opening at or on a bottom side of the refractory filling material dispenser, the refractory filling material dispenser being attached to a first end portion of the pivot arm and configured to dispense refractory filling material from the dispensing opening while the pivot arm is in the operating position, wherein the actuator link mechanism comprises a connector for selectively connecting the pivot arm and the pivot arm actuator, the connector being moveable by manual or powered actuation between a connecting position, where the connector connects the pivot arm and the pivot arm actuator such that the pivot arm actuator is configured to pivot the pivot arm between the parking position and the operating position in an automatic operation mode, and a disconnected position, where the connector does not connect the pivot arm and the pivot arm actuator, to enable a manual operation mode.

* * * * *